US005445117A

United States Patent [19]

Mendler

[11] Patent Number: 5,445,117

[45] Date of Patent: Aug. 29, 1995

[54] ADJUSTABLE VALVE SYSTEM FOR A MULTI-VALVE INTERNAL COMBUSTION ENGINE

[76] Inventor: Charles Mendler, 3522 Northampton St., NW., Washington, D.C. 20015

[21] Appl. No.: 189,325

[22] Filed: Jan. 31, 1994

[51] Int. Cl.[6] ..... F01L 1/08

[52] U.S. Cl. ..... 123/90.16; 123/90.18; 123/90.4; 123/90.42; 123/90.22

[58] Field of Search ..... 123/90.15, 90.16, 90.17, 123/90.18, 90.22, 90.27, 90.31, 90.39, 90.4, 90.41, 90.42, 90.44, 90.45, 90.6

[56] References Cited

U.S. PATENT DOCUMENTS

| | | | |
|---|---|---|---|
| 1,121,245 | 12/1914 | Herkt | 123/90.22 |
| 1,172,358 | 2/1916 | Herkt | 123/90.22 |
| 1,659,528 | 2/1928 | Hosterman | 123/90.33 |
| 3,618,573 | 11/1971 | Allen | 123/90.18 |
| 4,182,289 | 1/1980 | Nakajima et al. | 123/90.18 |
| 4,352,344 | 10/1982 | Aoyama et al. | 123/90.18 |
| 4,517,935 | 5/1985 | Pomfret | 123/90.4 |
| 4,570,581 | 2/1986 | Titolo | 123/90.18 |
| 4,791,893 | 12/1988 | Muranaka et al. | 123/90.4 |
| 4,825,822 | 5/1989 | Muranaka et al. | 123/90.4 |
| 4,913,104 | 4/1990 | Mills | 123/90.4 |
| 4,951,622 | 8/1990 | Takahashi et al. | 123/193 H |
| 5,038,732 | 8/1991 | Matayoshi et al. | 123/193 H |
| 5,099,806 | 3/1992 | Murata et al. | 123/90.16 |
| 5,211,143 | 5/1993 | Fontichiaro et al. | 123/90.18 |
| 5,259,346 | 11/1993 | Mills | 123/90.4 |
| 5,347,964 | 9/1994 | Reguiero | 123/90.42 |

FOREIGN PATENT DOCUMENTS

| | | | |
|---|---|---|---|
| 1945046 | 7/1971 | Germany | 123/90.18 |

*Primary Examiner*—Henry C. Yuen
*Assistant Examiner*—Weilun Lo
*Attorney, Agent, or Firm*—Cesari and McKenna

[57] ABSTRACT

An adjustable valve system for an engine (10) includes an axially shiftable camshaft (14) for connection to a source (24) of rotary power The shaft has at least one valve-actuating cam (28) with a lobe profile which varies along the axis of the camshaft (14). The system also includes a positioning mechanism (42) for controlling the axial position of the camshaft in said engine. A plurality of valves (36) control fluid communication with said engine (10). The system further includes a rocket (34) having contact portions which operatively engage the plurality of valves (36), mounting means (46) disposed in the engine for supporting the rocker and a cam follower (32) mounted on the rocker in rolling engagement with the cam (28). Exclusive pivots (**46*a*, 58) are provided which permit the follower (32) and/or the rocker (34) to pivot relative to said engine (10) about two axes ($A_1$,$A_2$), one of which is generally parallel to the camshaft (14) and the other of which is generally perpendicular to that shaft so that when the camshaft (14) is rotated, the follower (32) maintains line contact with the cam (28**).

37 Claims, 13 Drawing Sheets

ADJUSTABLE VALVE SYSTEM FOR A MULTI-VALVE INTERNAL COMBUSTION ENGINE

This invention relates to an internal combustion engine of the type having an axially shiftable camshaft for adjusting the opening and closing of the engine valves. It relates more particularly to an improved adjustable valve system for such an engine.

BACKGROUND OF THE INVENTION

Internal combustion engines usually have cylinder valves which are opened and closed by a rotary camshaft. The camshaft has cams spaced along the shaft. Associated with each cam is a cam follower attached to a rocker which engages a valve that is biased to its closed position by an appropriate spring. When the camshaft is rotated, the cam lobes rock their respective rockers causing the valves to open and close in sequence. The angular offsets and shapes of the cam lobes determine the valve lift, opening duration and timing. Usually, the axial position of the camshaft is fixed so that the valve motion profiles remain constant as the camshaft rotates.

Internal combustion engineers have known for some time that engine performance can be improved by adjusting the valve motion depending upon engine speed and load. To this end, some engines have been designed with axially shiftable camshafts. Such camshafts have cams whose rocker-actuating lobes have profiles which change depending upon the axial position of the shaft. For example, each lobe may have a complex surface shape which varies along the axis of the shaft. Thus, by positioning the camshaft in a desired axial location, the valve lift, valve opening duration and valve phase tinning may be set according to the particular requirements of the engine. Engines such as this are disclosed, for example, in U.S. Pat. Nos. 3,618,573 and 5,211,143.

FIGS. 1A and 1B illustrate the valve train of a typical adjustable valve system according to the prior art. The system incorporates a camshaft 2 with one cam 3, one pivoted cam follower 4, and one rocker 5 for each engine valve 6 that is biased to the closed position by a spring 7. The rocker is pivotally supported by a connection 8 to the engine cylinder head 9 so that follower 4 is in contact with the associated cam 3 so that when the camshaft 2 is rotated, the rockers 5 swing up and down thereby opening and dosing the valve 6. By shifting the axial position of the shaft 2, the valve lift, valve opening duration and valve phase timing may be set according to the particular requirements of the engine.

The prior systems of this type are disadvantaged in that to avoid mechanical collision of parts, the camshaft is limited to a relatively short allowable travel length $T_p$ (FIG. 1A). This necessitates the use of a relatively steep cam slope $S_p$ in order to accommodate the desired change in valve lift over that available travel length $T_p$. The travel length may be increased marginally in some prior systems by reducing the width $W_p$ of cam follower 4, but this results in increased contact pressure on and wear of the cam and cam follower. Short shaft travel length $T_p$, steep cam slope $S_p$ and narrow follower width $W_p$ produce several disadvantages.

First, the steeper axial slope of the cam 3 induces larger oscillating axial forces into the system which make unwavering axial positioning of the camshaft more difficult to accomplish, necessitating the use of an expensive camshaft axial positioning mechanism.

Further, since the camshaft can only move axially a short distance, that short axial travel of the shaft has to produce a large increase in engine power. Consequently, high precision tolerances are required to prevent significant changes in engine power from occurring due to axial play in the system. This precision requirement necessitates the use of an even more expensive camshaft axial positioning mechanism.

Additionally, with short axial travel length cams, the cam surface curvature must be more broadly rounded in order to avoid double contacts and impacts between the cams and their followers. In systems designed to achieve both continuous line contacts by the cam followers and no impacts between the cams and cam followers, as camshaft travel length is reduced, cam lobe variability and, therefore, valve motion adjustability is lessened. This constraint on valve motion adjustability has limited the utility of many prior art systems. Systems of the type described in the above two patents which utilize tappet-type cam followers are most limited in terms of valve motion adjustability.

The machine design problems just described can be lessened by limiting the range of variability of the adjustable valve system. However, this compromises the utility of the system. The limitations of prior art adjustable valve systems are recognized in the publication "A Survey Of Variable-Valve Actuation Technology", by T. Ahmad, Society of Automotive Engineering, Paper No. 891674, 1989 and "Type Synthesis Of Mechanisms For Variable Valve Actuation", by Charles W. Wampler, Society of Automotive Engineering, Paper No. 930818, 1993. The former article specifically states that in a survey of existing adjustable valve mechanisms, three-dimensional cams provide too narrow a range of duration and lift to allow adequate engine load control.

Still another disadvantage of prior art adjustable valve systems of the type described in the above two patents is that the valve rockers include flanges which transmit lateral forces from the camshaft to the valve stem ends. These lateral forces on the valve stem ends can cause accelerated wear of the valves and valve stem guides, as well as oil and/or fuel leakage past the valve stem guides, vibration and, in some cases, even breakage of the valve stems.

Additional disadvantages of the prior art adjustable valve systems include machine design complexity, excessive parts count and excessive manufacturing cost.

SUMMARY OF THE INVENTION

Accordingly, the present invention aims to provide an improved adjustable valve system for an internal combustion engine having an axially shiftable camshaft.

Another object of the invention is to provide such a system which maintains line contacts between the camshaft cams and their followers, while also allowing a maximum amount of axial movement of the camshaft for valve adjustment purposes.

A further object of the invention is to provide an adjustable valve system of this type which minimizes axial oscillations of the camshaft.

Still another object of the invention is to provide an adjustable valve system which permits a maximum amount of valve motion adjustability.

A further object of the invention is to provide a valve motion control system which is relatively easy and inexpensive to manufacture.

Other objects will, in part, be obvious, and will, in part, appear hereinafter.

The invention accordingly comprises the features of construction, combination of elements and arrangement of parts which will be exemplified in the following detailed description, and the scope of the invention will be indicated in the claims.

The present adjustable valve system has an axially shiftable camshaft including one or more cams each having a complex cam lobe surface profile. Each cam bears on a cam follower mounted to a rocker. In accordance with the invention, each rocker bears on a plurality of valves. Shifting the camshaft axially changes the lobe profile of the cam which bears on each cam follower and thereby changes the valve lift, timing, and/or opening duration of the associated valve.

Further in accordance with this invention, line contact is maintained between each cam follower and its cam at all rotational and axial positions of the camshaft thereby minimizing parts wear. This line contact may be achieved in a variety of different ways to be described in detail later. Suffice it to say at this point that, in some cases, the rocker pivots about a first axis and the cam follower pivots about a second axis different from the first axis; in other cases, the follower does not pivot at all relative to the rocker, but the rocker is free to pivot about two axes so that line contact is maintained between the cam follower and the associated cam.

These features combine to materially reduce or eliminate the problems described above that plague prior systems of this type. Furthermore, this is accomplished with a cost saving due to the ability to use fewer and less expensive parts for the system. For example, in a typical prior art adjustable valve system described above, there may be, for each pair of cylinder intake valves, two rockers, two followers, two lifters, two follower mounting blocks, two springs and two clips, or a total of twelve parts. This compares with the six parts required for each valve pair in a conventional engine with no adjustable valve control. As we shall see, in one embodiment of the present system, four (and sometimes only two) parts per valve pair are utilized resulting in a significant cost saving.

BRIEF DESCRIPTION OF THE DRAWINGS

For a fuller understanding of the nature and objects of the invention, reference should be had to the following detailed description, taken in connection with the accompanying drawings, in which.

DETAILED DESCRIPTION OF ILLUSTRATIVE EMBODIMENTS

Figure 2:
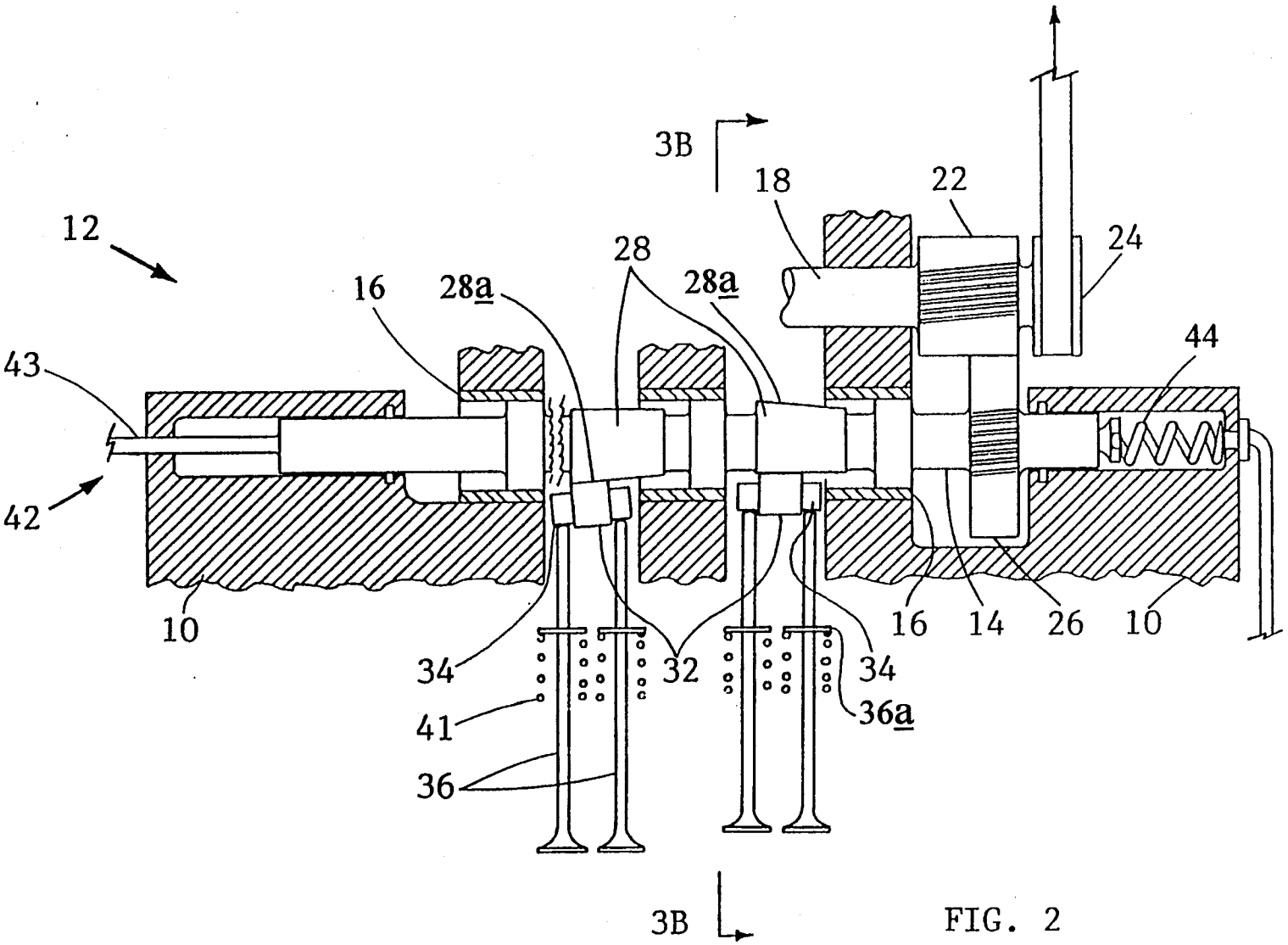
FIG. 2 is a fragmentary sectional view with parts in elevation showing an adjustable valve system incorporating my invention.

Refer now to FIG. 2 of the drawings which shows the cylinder head 10 of an internal combustion engine which incorporates my improved adjustable valve system shown generally at 12. The valve system 12 includes an overhead camshaft 14 which is rotatably mounted by way of bearings 16 in the walls of the cylinder head 10. Bearings 16 also allow for a certain amount of axial motion of the camshaft for valve motion control purposes as will be described. Camshaft 14 may be rotated by suitable means such as by the gear shaft 18 also rotatably mounted in the head 10. The forward end of shaft 18 carries a gear 22 located behind a driven belt pulley 24 at the forward end of that shaft. Gear 22 meshes with a gear 26 mounted to the forward end of camshaft 14.

Camshaft 14 is formed with a plurality of cams 28 distributed along its length. For ease of illustration, we have shown only two such cams 28. Associated with each cam 28 is a cam follower 32 which bears against the surface of the cam. Each cam follower is connected to a rocker 34 which engages the upper ends of two or more valves 36 which open and close ports communicating with the engine's cylinders or working chambers (See FIGS. 13). The various valves 36 may be biased to their closed positions by coil springs 41 compressed between flanges **36*a* on the valve stems and an underlying wall of the cylinder head 10**.

Figure 3A:
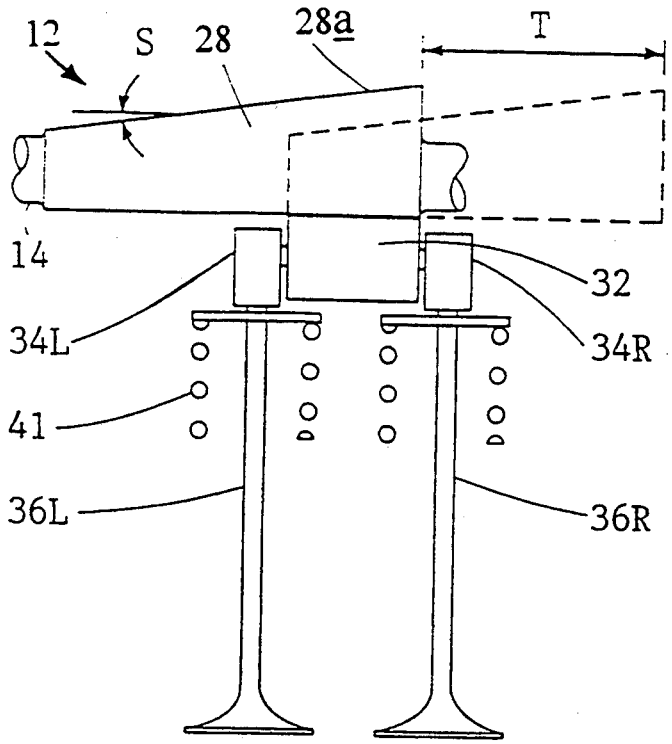
FIG. 3A is a similar view on a larger scale showing a portion of the FIG. 2 system in greater detail.
Figure 3B:
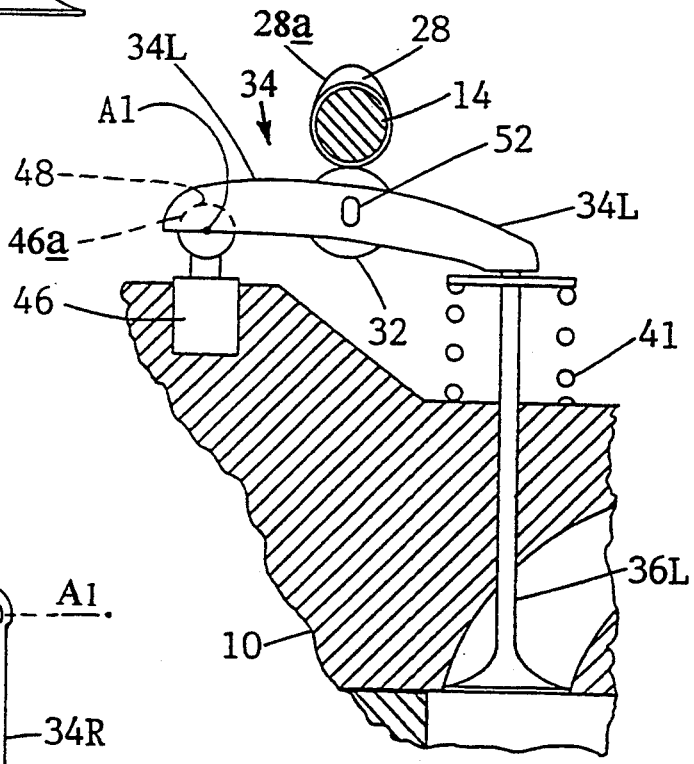
FIG. 3B is a sectional view on a larger scale taken along line 3B—3B of FIG. 2, showing the valve rocker in greater detail.

As best seen in FIGS. 3A and 3B, each cam 28 on camshaft 14 has a raised portion or lobe **28*a*. When the camshaft 14 is rotated to position that lobe opposite the associated cam follower 32, the associated cam follower and rocker are depressed thereby opening the valves 36 associated with that rocker. Also, the profile of each cam 28 lobe may vary along the axis of the camshaft 14. Accordingly, the timing, lift and opening duration of the valves being controlled by each cam 28 can be altered by repositioning camshaft 14 axially with respect to cylinder head 10 and the cam followers 32 whose axial positions are fixed with respect to the head. The illustrated cams 28 are shown as having a tapered profile with a slope S (FIG. 3A). It should be understood that cam lobes 28*a*** may have a variety of different complex shapes depending upon the valve motion characteristics desired for the particular engine.

As shown in FIG. 2, the camshaft 14 may be moved axially by means of a suitable shaft positioning mechanism 42 which adjusts the axial position of shaft 14 depending upon engine parameters such as speed and load. In the illustrated system, mechanism 42 comprises a push rod 43 which engages one end, e.g., the left end, of cam shaft 14 and is linked to the acceleration pedal (not shown) of the vehicle containing engine 10. When that pedal is depressed, push rod 43 moves shaft 14 to the right. A return spring 44 is compressed between the right hand end of camshaft 14 and engine 10 to bias shaft 14 to the left as the force excerted by the push rod 42 is reduced when the accelerator pedal is depressed a lesser amount. Of course, other more sophisticated camshaft positioning mechanisms known to those skilled in the art may be employed. The mechanism 42 is designed so that it can position any axial segment of each cam 28 opposite its associated follower 32. Thus, referring to FIG. 3A, the shaft positioning mechanism may position shaft 14 as shown in solid lines in that figure so that the, right hand end segment of cam 28 lies opposite the associated follower 32. In response to different engine speed or load conditions, the mechanism 42 may shift camshaft 10 toward the right up to a maximum distance T as shown in phantom in FIG. 3A to position segments of cam 28 having other slopes opposite the follower 32 thereby changing the valve 36 motion characteristics to best accommodate those different engine speeds or loads.

Figure 1A:
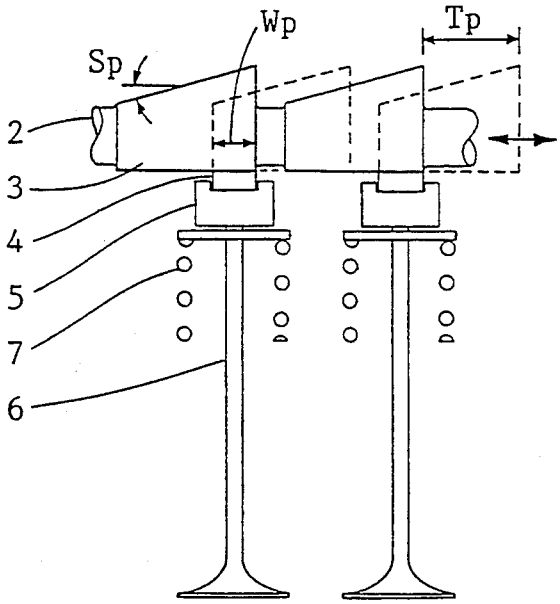
FIG. 1A PRIOR ART
FIGS. 1A and 1B, already described, are fragmentary side and front elevations, of an adjustable valve system for an internal combustion engine according to the prior art.
Figure 1B:
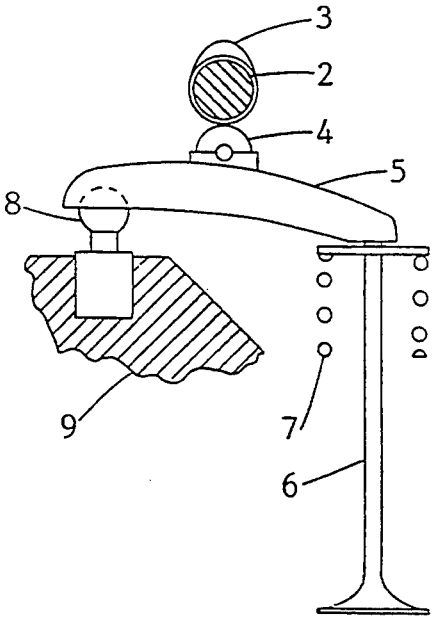
FIG. 1B PRIOR ART

Referring to FIGS. 2 and 3A to 3C, it is a feature of this invention that all of the cam followers 32 in the adjustable valve system 12 achieve line contacts with the cams 28 of camshaft 14 so as to minimize the stress and wear of those parts. Furthermore, this is accomplished using relatively wide cam followers 32. Indeed, the width W (FIG. 3C) of each cam follower 32 is substantially greater than that of the followers used in prior engines with axially shiftable camshafts. An adjustable valve system according to this invention should permit camshaft axial travel length T up to twice the length $T_p$ allowed by prior systems such as the one shown in FIG. 1. It should also allow a cam slope S much smaller than those found in prior systems. Moreover, this can be accomplished using wider than usual cam followers which are, therefore, quite robust and reliable.

It should be appreciated also that an even longer camshaft travel length T and a significantly shallower cam slope S and a wider follower width W can be attained in engines having only one intake valve per cylinder and one rocker that bears on two intake valves housed in adjacent cylinders.

The present system is able to permit a large range of camshaft adjustment while avoiding mechanical collision of parts. In the preferred embodiment, each rocker activates a plurality of valves. Additionally, in some embodiments, the surface profile of the cam in combination with the geometry of the rocker permits a larger range of camshaft adjustment. Part wear is minimized by designing each cam lobe surface and follower assembly (i.e., cam follower and rocker) so that the cam follower maintains a relatively long line contact with the corresponding cam 28 on the camshaft 14. Manufacturing cost is minimized by minimizing the number of parts in the system and by minimizing the precision and complexity of the parts. There are various ways of designing the followers and rockers to meet these objectives of a large range of adjustment, durability, and low cost.

The present system is able to permit a large range of camshaft adjustment while avoiding mechanical collision of parts by having each rocker activate a plurality of valves 36. Parts wear is minimized by designing each cam lobe surface and cam follower assembly (i.e., cam follower and rocker) so that the cam follower maintains line contact with the corresponding cam 28 on camshaft 14. There are various ways of designing the followers and rockers to meet these twin objectives.

Figure 3C:
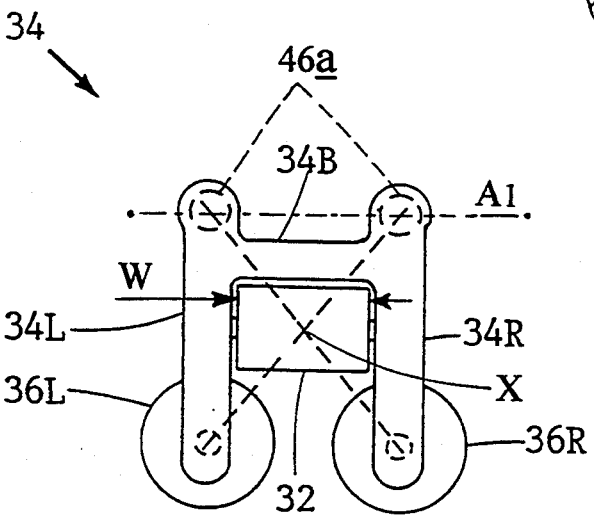
FIG. 3C is a plan view showing a rocker and cam follower of the FIG. 2 system.

Referring to FIGS. 3A to 3C, the rocker 34 in the adjustable valve system 12 has a pair of parallel arms 34L and 34R connected by a bridging portion 34B giving the rocker the general shape of the letter H. The follower 32 is rotatably mounted to rocker 34 so that the rocker arms 34L and 34R straddle the follower. The inboard end of rocker 34 is swingably supported on the cylinder head 10 between camshaft 14 and follower 32 by a pair of pedestals 46. Those pedestals have upstanding spherical tops 46*a* which seat in hemispherical recesses 48 in undersides of the rocker arms 34L and 34R. The rocker is arranged and adapted so that the outboard ends of the arms 34L and 34R engage the upper ends of the valves 36L and 36R and so that the follower 32 mounted to the rocker is biased into engagement with the associated cam 28 of camshaft 14 by the valve spring 41. Thus, as the camshaft 14 rotates, the rocker pivots on tops 46*a* about an axis $A_1$ (FIG. 3B) thereby opening and closing valves 36L and 36R. In the illustrated system, axis $A_1$ is generally parallel to camshaft 14, but it does not have to be. If desired, a conventional automatic or manual lash adjustor may be provided to control the clearance between each valve and the rocker.

As shown in FIG. 3C, for each rocker 34, imaginary lines connect each pedestal top 46*a* and the point of contact with a diametrically opposed valve 36. These imaginary lines intersect at a location X which is centered on the associated cam follower's pivot axis, which enables independent lash adjustment of each valve 36L and 36R. Note that the distance between pedestals 46 may be adjusted to change the position of location X. Independent lash adjustment may be accomplished by means of hydraulic lash adjustors mounted in cylinder head 10 accompanying pedestals 46. Alternatively, manual screw-type lash adjustors may be mounted in the rocker opposite one or both valves 36L and 36R; see FIG. 6B. Of course, a combination of automatic and manual lash adjustors or some other lash adjustment arrangement known to those skilled in the art may be used.

Figure 4A:
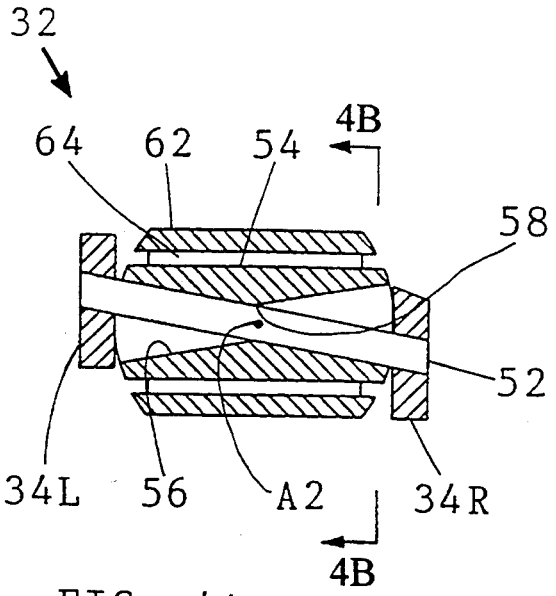
FIG. 4A is a vertical section on a still larger scale of the cam follower in the FIG. 2 system with the cam follower in one position of adjustment.
Figure 4B:
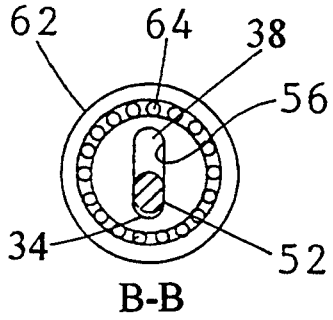
FIG. 4B is a sectional view taken along line 4B—4B of FIG. 4A.
Figure 4C:
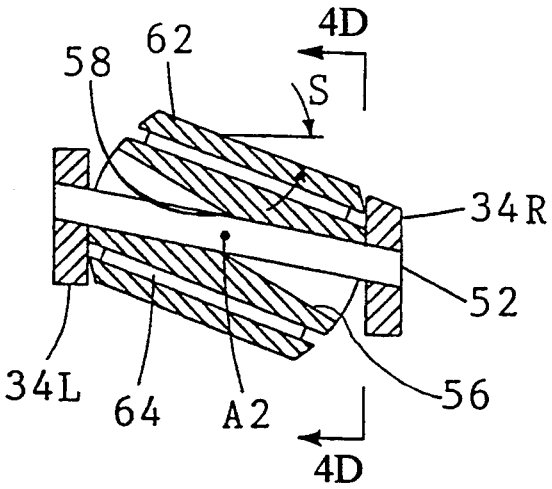
FIG. 4C is a view similar to FIG. 4A showing the cam follower in another position of adjustment.
Figure 4D:
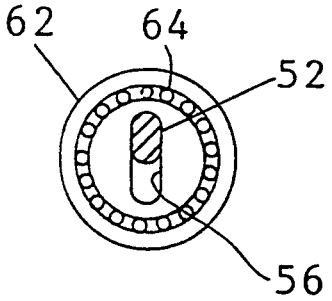
FIG. 4D is a sectional view taken along line 4D—4D of FIG. 4C.

Refer now to FIGS. 4A to 4D which show the cam follower 32 and its connection to rocker 34 in greater detail. Each follower 32 is supported on a shaft 52 which extends between the rocker arms 34L and 34R. Shaft 52 has a cross section which is non-round, e.g., elongated. The follower includes an inner hub 54 having an axial slot 56 which receives shaft 52 and which also has an elongated cross section. Furthermore, the opposite end segments of slot 56 are flared vertically so that hub 54 can pivot about a pivot point or fulcrum 58 midway between the ends of the hub. In other words, the interfit between shaft 52 and the hub is such that the hub is prevented from rotating about the shaft but is free to pivot relative to the shaft about an axis $A_2$ that is oriented at an angle with respect to camshaft 14, and generally perpendicular to axis $A_1$ shown in FIGS. 3B and 3C. The follower 32 also includes an outer sleeve 62 which is rotatably mounted to hub 54 by way of a bearing unit 64 so that the sleeve can be in contact with the associated cam 28. Thus, the follower is free to pivot relative to its rocker 34 about the axis $A_2$. The described pivotal motions of both the rocker and the cam follower allow the follower to maintain line contact with its cam 28 at substantially all axial positions of the camshaft. In practice, each cam may disengage from the associated cam follower very briefly each time the valve is closed to insure that the valve is, in fact, fully closed. FIGS. 4A and 4B illustrate the follower 32 rotated to a first position relative to rocker 34, while FIGS. 4C and 4D show the follower tilted in the opposite direction to a second position relative to the rocker. The follower also includes an outer sleeve 62 which is rotatably mounted on hub 54 by way of a bearing unit 64 so that the sleeve 62 can be in rotational contact with the associated cam 28.

It should be appreciated that other means may be employed to restrict the cam follower 32 to pivotal motion about only the one axis $A_2$ which is generally perpendicular to camshaft 10. For example, a vertically elongated slot 56 may extend all the way through hub 54 and a fulcrum in the form of a vertically elongated flange (not shown) provided midway along shaft 52.

Figure 5:
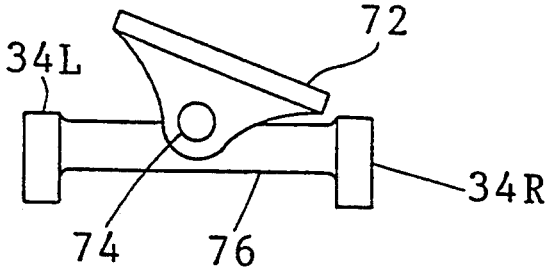
FIG. 5 is a side elevational view of a different rocker/cam follower embodiment for use in the FIG. 2 system.

FIG. 5 shows a cam follower for use in system 12 in the form of a tappet 72 which is connected by a pivot pin 74 to a shaft or cross member 76 extending between the rocker arms 34L and 34R. Like follower 32, the tappet 72 can pivot about an axis $A_2$ that is oriented at an angle with respect to camshaft 14 which allows the tappet to maintain proximate line contact with its associated cam lobe at all axial and rotational positions of the camshaft 14.

Figure 6A:
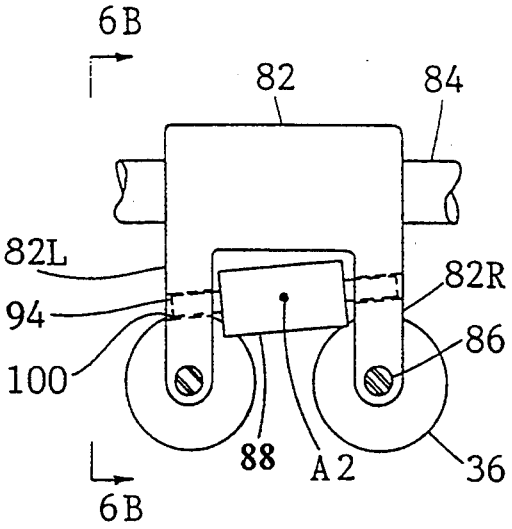
FIG. 6A is a plan view showing another rocker/cam follower embodiment for use in the FIG. 2 adjustable valve system.
Figure 6B:
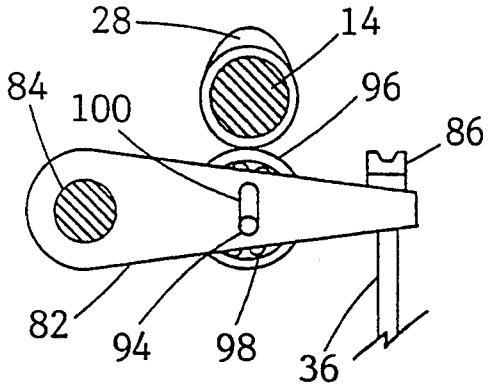
FIG. 6B is a sectional view taken along line 6B—6B of FIG. 6A.
Figure 6C:
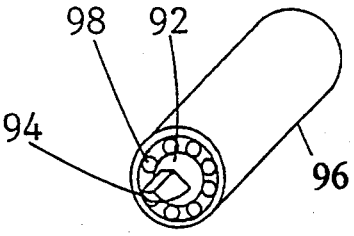
FIG. 6C is a isometric view showing the FIG. 6A cam follower in greater detail.

Refer now to FIGS. 6A, 6B and 6C which illustrate another rocker/follower arrangement which achieves line contact between each follower and its cam 28. In this embodiment, a rocker indicated at 82 is pivoted on a shaft 84 which extends through the inboard end of the rocker. The rocker 82 has a pair of spaced-apart generally parallel arms 82L and 82R which extend out to the valves 36 being actuated by that rocker. Manual screw-type lash adjustors 86 may be incorporated into the outboard ends of the rocker arms 82L and 82R.

A roller-type cam follower 88 is supported between the rocker arms 82L and 82R. The follower includes a cylindrical hub 92 having a pair of stub shafts 94 with non-round cross sections projecting from the opposite ends of the hub. A sleeve 96 is rotatably mounted on hub 92 by way of a bearing unit 98. Stub shafts 94 are supported in vertically elongated slots 100 present in the opposing walls of the rocker arms 82L and 82R such that follower 88 is free to pivot about an axis $A_2$ that is oriented at an angle with respect to the axis of the camshaft 14 so as to maintain line contact between the follower sleeve 96 and the associated camshaft cam 28. In the illustrated system, the axis $A_2$ is more or less perpendicular to the camshaft.

Figure 7A:
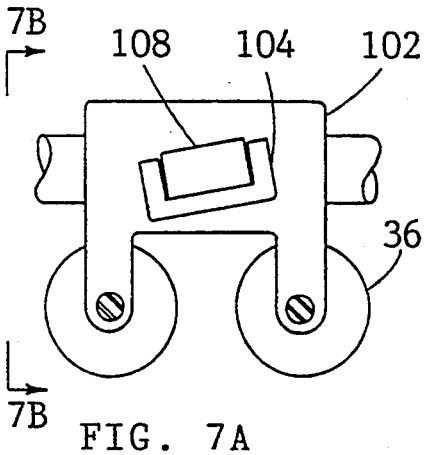
FIG. 7A is a plan view of still another rocker/cam follower arrangement for use in the FIG. 2 adjustable valve system.
Figure 7B:
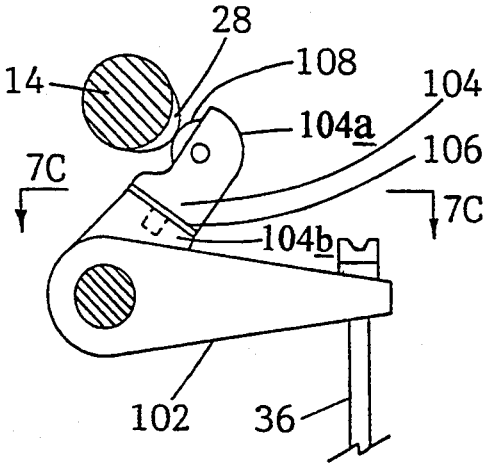
FIG. 7B is a sectional view taken along line 7B—7B of FIG. 7A.
Figure 7C:
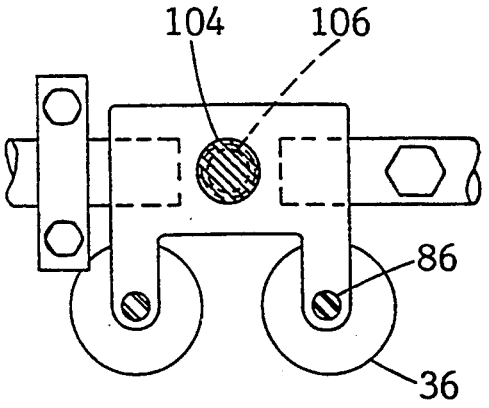
FIG. 7C is a sectional view taken along line 7C—7C of FIG. 7B.

Refer now to FIGS. 7A to 7C which illustrate yet another arrangement for maintaining line contact between a cam follower and its cam. It includes a central pivot shaft rocker 102 which moves associated valves 36. Rocker 102 is similar to rocker 82 just described except that it includes an upstanding swivel post 104 comprising upper and lower sections 104*a* and 104*b* which are rotatably connected by a bearing unit 106 so that section 104*a* can rotate about the longitudinal axis of post 104 which axis is angled with respect to the camshaft axis. A roller-type cam follower 108 is rotatably mounted near the top of section 104*a* for rolling engagement with the cam 28 of camshaft 14. As the camshaft revolves and is shifted axially, the cam follower 108 maintains rolling line contact with the cam 28.

It will be appreciated that all of the different rocker/-cam follower arrangement depicted in FIGS. 4 to 7 can be used in the FIG. 2 adjustable valve system.

During operation of the FIG. 2 system, rotation of the camshaft 14 will cause the various valves 36 associated with the different cams 28 to open and close in sequence. In response to different engine speed and load conditions, the control mechanism 42 (FIG. 2) will adjust the camshaft 14 axially thereby changing the valve timing, lift and dwell profiles to suit the different operating circumstances.

Referring to FIG. 2, while totally power may be coupled from the gear shaft 18 to the camshaft 14 by means of conventional spur gears, preferably the gears 22 and 26 that perform that function are helical gears so that when the gear 26 is moved axially along with camshaft 14, the phase angle or timing of shaft 14 will be adjusted relative to the gear shaft 18, and, in turn, shaft 14 is adjusted relative to the crank shaft of the engine. This adjustment of the timing enables the surface curvature complexity of the cams 28 to be reduced and improves the mating contact between the followers and the respective cams 28. This, in turn, contributes to improved durability and can reduce manufacturing cost. In certain circumstances, the pitch or slope of the teeth of gears 22 and 26 can be made generally opposite to the slope S of cams 28 so as to partially cancel out axial forces applied to the camshaft 14 by the gears and the rockers 34. Also, under certain circumstances, the slope or pitch of the helical teeth may change along the axial length of gear 22 (and to a lesser extent along the length of gear 26) to vary the phase change introduced by the gears as the camshaft 14 is adjusted axially. For example, the teeth may be designed to have no slope or pitch along part or all of the gear length. The least expensive construction, however, is for the gear teeth to have constant pitch along the gear.

In the adjustable valve systems described thus far, line contact between each cam follower and its respective cam 28 is obtained by providing a pivotal connection between each follower and its associated rocker which allows the follower to pivot about an axis $A_2$ that is more or less perpendicular to the camshaft. Such contact can also be maintained by constraining each rocker to pivot about orthogonal axes, one axis $A_1$ being generally parallel to the camshaft and the other axis $A_2$ being generally perpendicular to that shaft.

FIG. 8A to 8D illustrate a typical rocker for an adjustable valve system of this type. The rocker 120 includes a pair of spaced generally parallel arms 122R and 122L. The arms are joined at a shoulder portion 124 which tapers to an elongated cylindrical neck 126. Rocker 120 is supported by a pedestal 128 mounted to a cylinder head 132. More particularly, pedestal 128 includes an upstanding ball stud 128*a* which is received in a hemispherical recess 134 in the underside of the rocker neck 126. The pedestal may include an automatic lash adjustor (not shown), as is well known in the art.

When properly supported on pedestal 128, the rocker arms 122R and 122L extend under the camshaft 14 and to the upper ends of a pair of valves 138R and 138L which are both actuated by that one rocker 120. Valves 138R and 138L control fluid communication between a working chamber or cylinder of the engine and an associated port as is well known in the art; see FIG. 13.

A shaft 142 extends between the rocker arms 122R and 122L. This shaft supports a roller-type cam follower 144 which is rotatably mounted on the shaft so that the follower is in rolling contact with a corresponding cam 28 of camshaft 14. Of course, tappet-type followers could be used as well. When camshaft 14 rotates, the cam lobe 28*a* of cam 28 will cause rocker 120 to pivot on ball stud 128*a* about a first axis $A_1$ which is generally parallel to the axis of the camshaft, and also about a second axis $A_2$ oriented at an angle with respect to the cam shaft, which is generally perpendicular to axis $A_1$ so as to maintain line contact between cam 28 and follower 144. Also, when camshaft 14 is adjusted axially to change the operating characteristics of the engine, rocker 120 will pivot on the ball stud 128*a* about a second axis $A_2$ oriented at an angle with respect to the camshaft, e.g. perpendicular, so as to maintain line contact with cam 28.

In order to confine the motion of rocker 120 to motion generally about the two axes $A_1$ and $A_2$, one or more guides 142 project up from the cylinder head 132 on opposite sides of the rocker neck 126. As shown in FIGS. 8A to 8D, these guides define a slot or channel 144 which snugly receives neck 126 so that the neck can only move up and down in the slot or rotate about axis $A_2$. Of course, other means may be provided to confine the motion of the rocker as described. Also, to minimize friction between the rocker and guides 142, the free end of the rocker neck 126 may be formed as a roller 127 rotatably mounted to the rocker body for rotation about axis $A_2$ as shown in phantom in FIG. 8B.

While the arms 122R and 122L of rocker 120 may be of equal length, they are specifically shown as being of unequal length, arm 122R being longer than arm 122L. Resultantly, there is a separation angle between the two valves associated with the rocker which may be reduced by increasing the lengths of the valves. Additionally, while not shown specifically, axis $A_1$ may be set at an angle relative to the camshaft 14. In this event, the stems of valves 36 may be oriented parallel to one another. In the illustrated system, axis $A_1$ is considered to be generally parallel to camshaft 14 and axis $A_2$ is considered to be generally perpendicular to camshaft 14 even in situations where the angulation is relatively large. In general, the system can be arranged to perform in more or less the same manner when valve angulation is present and when it is not. Throughout the specification and in the claims, the terms "parallel" and "perpendicular" should be construed broadly to include these deviations from exact parallel and perpendicular orientations.

Figure 8B:
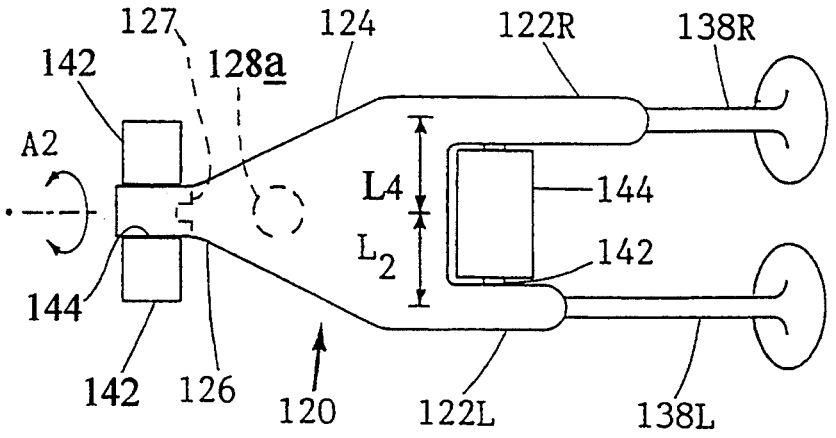
FIG. 8B is a plan view thereof.
Figure 8A:
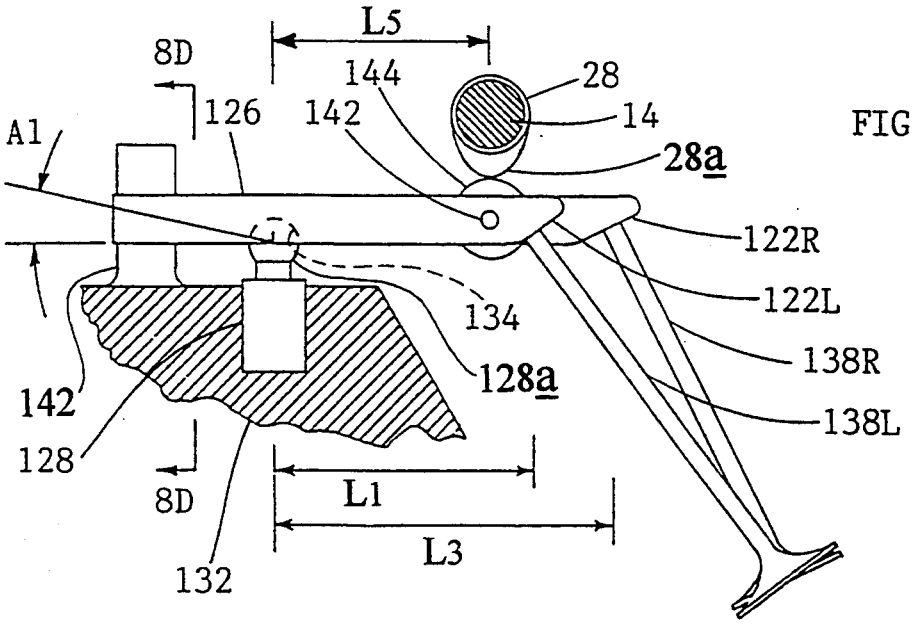
FIG. 8A is a sectional view showing yet another rocker/cam follower embodiment for use in the FIG. 2 system.
Figure 8C:
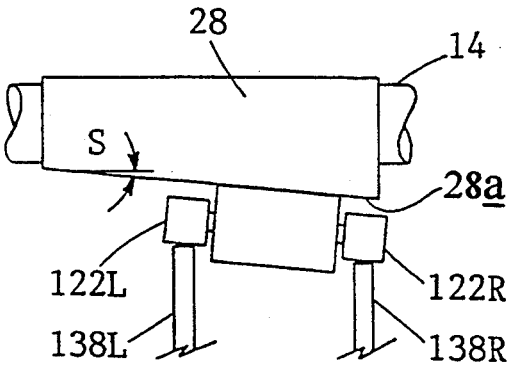
FIG. 8C is a fragmentary side elevational view of a portion of the FIG. 8A embodiment.
Figure 8D:
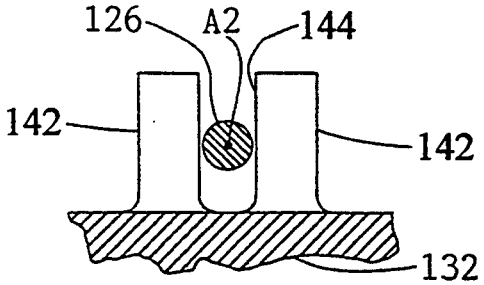
FIG. 8D is a sectional view taken along line 8D—8D of FIG. 8A.

As shown in FIGS. 8A and 8B, when the camshaft 14 is rotated, valve 138L is depressed by rocker 120, pivoting on axes $A_1$ and $A_2$ and acting through the lever arms $L_1$ and $L_2$. On the other hand, valve 138R is depressed by the rocker 120 pivoting on axis $A_1$ and $A_2$ and acting though the lever arms $L_3$ and $L_4$. Lever arm $L_5$ is the distance between the follower's line of contact with can 28 and the intersection of A and $A_2$.

Referring to FIGS. 8A and 8B, it should be evident that the radial height of the cam lobe 28*a* acting through lever arm $L_5$ and the axial slope of the cam lobe acting through distance $L_4$ determine the lift profile of valve 138R. It is an important feature of the present invention that valve motion is controlled by two lever arms because the contribution of lift of each lever arm can be adjusted to provide the desired range of valve lift profiles for a given valve. Additionally, it should be evident that my invention including one rocker with two pivot axes and two lever arms can be arranged to displace a single valve or multiple valves. Systems including one rocker per valve are described below with reference to FIGS. 15.

Figure 9A:
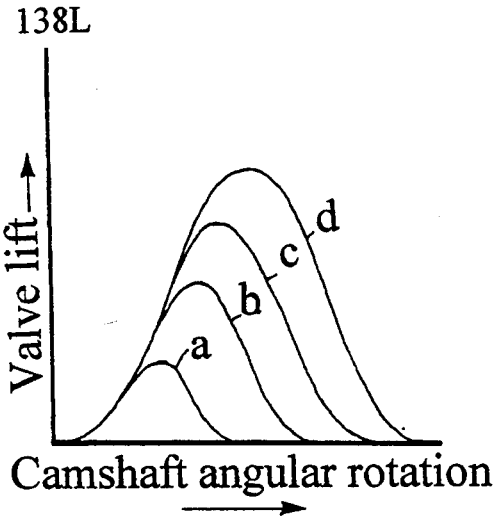
FIGS. 9A and 9B are diagrammatic views illustrating the operation of the FIGS. 8 system embodiment.
Figure 9B:
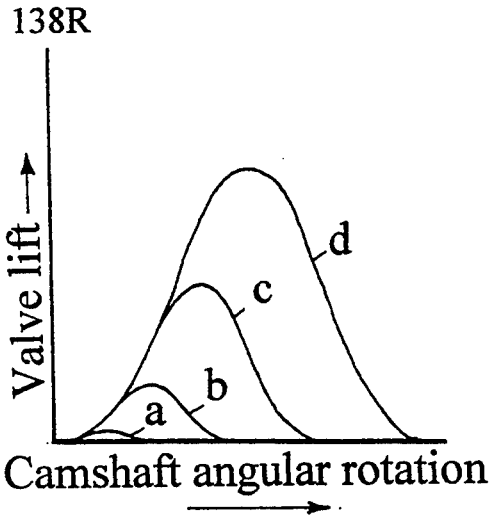

Refer now to FIGS. 9A and 9B which show typical lift profiles for valves 138L and 138R, respectively, at various angular positions of the camshaft. The waveforms a to d represent the profiles at different axial positions at the camshaft 14. At the camshaft positions represented by waveforms a and b, the valve 138L has greater lift than the valve 138R. Generally, valve settings between the shaft positions represented by curves a and b, would typically be employed to idle the engine or to produce a small amount of power. Note that at the shaft position represented by waveform a, valve 138R may be open slightly to prevent fuel build-up in the manifold which could cause damage to the valve and the associated valve seat.

At the camshaft position represented by waveform d, valves 138L and 138R have approximately equal lift. This valve setting would typically be employed to maximize air intake into the engine cylinder and thereby maximize power of a naturally aspirated engine. In a turbocharged engine, maximum power may be obtained with a smaller valve setting because the intake air is pre-compressed in part by the turbocharger. The camshaft setting for maximum power in a turbocharged engine depends on whether the engine employs spark or diesel ignition, whether an intercooler is employed, whether a variable compression ratio is employed and on other factors.

Since the relative lift of valves 138L and 138R is dependent on the lever arm lengths $L_1$ to $L_5$ and the angular rotation of rocker 120 about pivot axes $A_1$ and $A_2$, it should be apparent that valve opening profiles other than those depicted in FIGS. 9A and 9B can be realized by appropriately adjusting the lengths and/or spacings of the rocker arms 122R and 122L, the location of follower 144, and the surface profile of the cam shaft's cam 28. In one scenario, for example, the rocker may be made with arms of equal length and with valve stems parallel to each other in order to minimize manufacturing cost and, in this arrangement, one valve may open more than the other at maximum engine power.

Still referring to FIGS. 9A and 9B, in prior art engines employing adjustable valves to limit air intake into the engine cylinders, combustion tends to be unstable at idle and at small power output levels whose compression pressure and temperature are at a minimum. This is because with an adjustable valve system, intake air enters the engine cylinder at lower velocity and with less entropy than is the case in conventional engines. In conventional engines, higher gas velocities aid turbulent mixing during combustion and higher entropy levels yield increased cylinder temperatures and pressures which benefit ignition and combustion stability. At the camshaft position represented by waveform a in FIGS. 9A and 9B, valve 138L has greater lift than valve 138R. Consequently, at this setting, air enters the cylinder mostly through valve 138L. Air entering the cylinder primarily through one valve can, given an appropriate manifold design, promote swirl in the cylinder. This swirl should improve combustion stability by increasing mixing of the burning gases. Stable combustion at idle and light power levels can be enhanced further by a stratified charge. Such a stratified charge concentrates a rich fuel-mixture near the spark plug, which improves ignition reliability. A suitable technique for attaining a stratified charge will be described in more detail later in connection with FIG. 13.

Still referring to FIGS. 9A and 9B, at the shaft position represented by waveform d in those figures, valves 138L and 138R have approximately equal lift. This valve setting will typically be employed in a naturally aspirated engine at maximum power to maximize air intake into the cylinder. With both valves open, swirl is expected to be less developed in the cylinder. However, with both valves open, more air is admitted into the cylinder and, therefore, greater cylinder pressures and temperatures are developed during compression and combustion. Because of these greater pressures and temperatures, intake air swirl and charge stratification is unnecessary for reliable ignition.

It should be appreciated that alternative valve opening strategies can be implemented with my adjustable valve system. For example, valve opening may be tuned for sonic intake flow at low engine break mean effective pressure (BMEP) levels to promote turbulent mixing in the combustion chamber. It should also be noted that my system permits use of higher compression ratios, which by itself improves ignition reliability. It should also be recognized that the valve lift profiles shown in FIGS. 9A and 9B can be achieved, with two rockers of the type shown in FIGS. 3A to 3C with one rocker activating one intake valve and the other rocker activating the other intake valve.

Figure 10A:
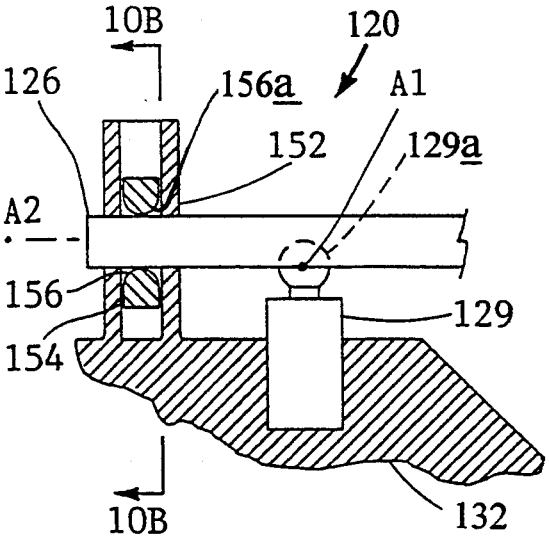
FIG. 10A is a fragmentary vertical section showing a modified rocker connection for use in my adjustable valve system.
Figure 10B:
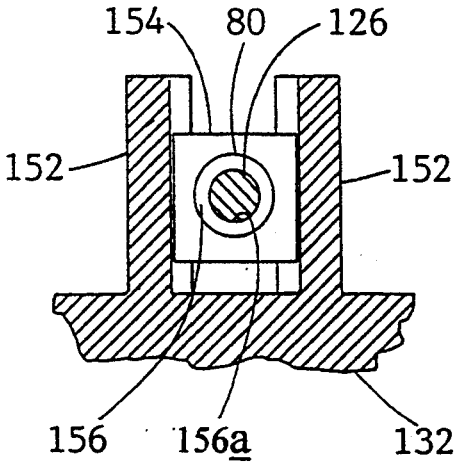
FIG. 10B is a sectional view taken along line 10B—10B of FIG. 10A.

Refer now to FIGS. 10A and 10B which illustrate another arrangement for confining the motion of rocker 120 to rotations about the two axis $A_1$ and $A_2$ and to accomplish this with minimum friction and parts wear. In lieu of the guides 142, a pair of spaced-apart slides 152 project up from the cylinder head 132. Positioned in the slide is a vertically movable slider 154 having a central opening 156 for receiving the cylindrical rocker neck 126. Preferably, the edge of opening 156 is beveled to provide a rounded rim guide surface **156*a* to minimize friction between the rocker and the slider 154. It should be appreciated that conventional bearing means may be employed between the rocker neck and the slider 154 and between the slider and the slides 152 to further minimize friction between those parts as the rocker pivots about its two axes $A_1$ and $A_2$. Also, while we have shown the slides 152 as being located outboard of the rocker-supporting pedestal 128, it should be understood that they could just as well be located inboard of the pedestal so that the slides constrain the mid portion of rocker 120. The same is true with regard to the guides 142 described in connection with FIGS. 8A to 8D**.

Figure 11A:
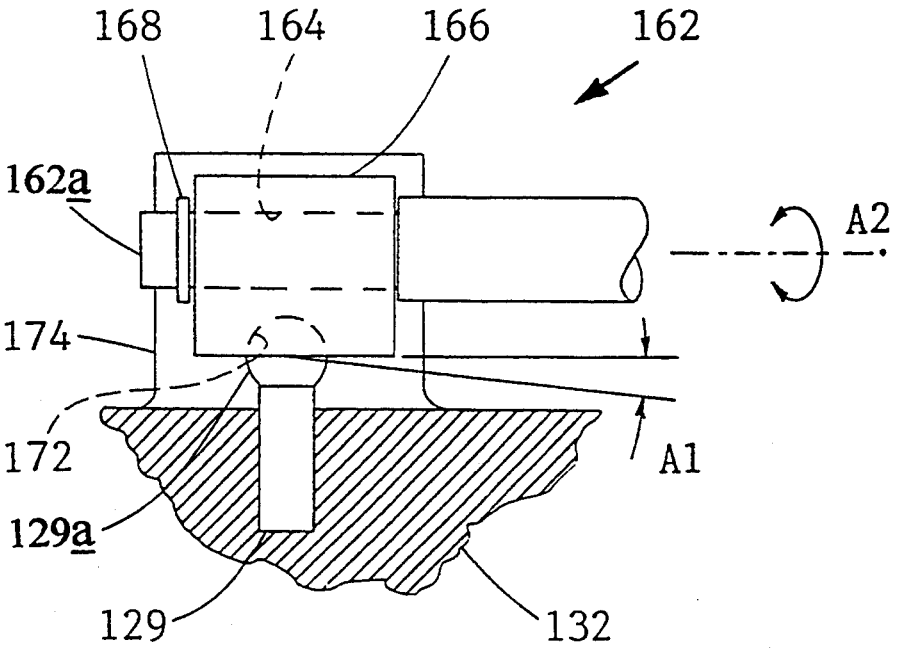
FIG. 11A is a fragmentary sectional view showing still another rocker connection for use in my adjustable valve system.
Figure 11B:
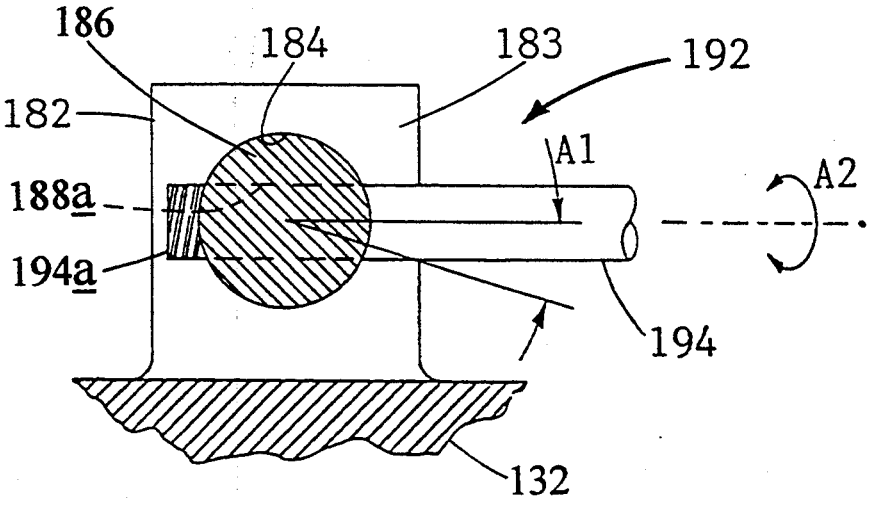
FIG. 11B is a similar view showing yet another rocker connection.

FIGS. 11A and 11B show still other means for supporting a rocker for motion about only the two axis $A_1$ and $A_2$. In FIG. 11A, the rocker, shown generally at 162, has a reduced diameter cylindrical neck **162*a* which is rotatably received in an axial bore 164 in a knuckle 166 having a generally rectangular cross section. The neck 162*a* may be retained in place within bore 164 by a C-clip 168 or equivalent means. The knuckle 166 has a cylindrical recess 172 in its underside which seats on the mating cylindrical surface 129*a* of pedestal mounting 129. A pair of spaced-apart guides 174 are provided on both sides of knuckle 166 to confine the motion of the knuckle to pivotal movement about the axis $A_1$. The rocker 162 is free to rotate about axis $A_2$ so that as the associated camshaft rotates, the cam follower (not shown) at the outboard end of rocker 162 maintains line contact with the associated cam of the camshaft, as described above. In lieu of the cylindrical connection between knuckle 166 and pedestal 129, the knuckle may be pivotally connected to the upper end of the pedestal. If that pivotal connection is tight enough, the guides 174** may not be required.

FIG. 11B illustrates a combined rocker mount and alignment assembly. In this case, the cylinder head 132 is provided with a pair of spaced apart upstanding walls 182, only one being shown, which define a slot 183. Each wall has a central passage 184. Rotatably positioned in passage 184 is a cylindrical knuckle 186. The knuckle 186 contains a diametric bore **188*a* whose interior end is threaded at 188*a*. A rocker shown generally at 192 is provided with a cylindrical neck 194 whose free end 194*a* is also threaded. Thus, in this arrangement also, the rocker 192 can only rotate about axis $A_1$ or $A_2$. Here, however, due to the threaded connection between the rocker and the knuckle 186**, a rotation of the rocker about axis $A_2$ changes the effective length of the rocker. This slight axial motion may reduce friction between the rocker and the associated valves.

Figure 12A:
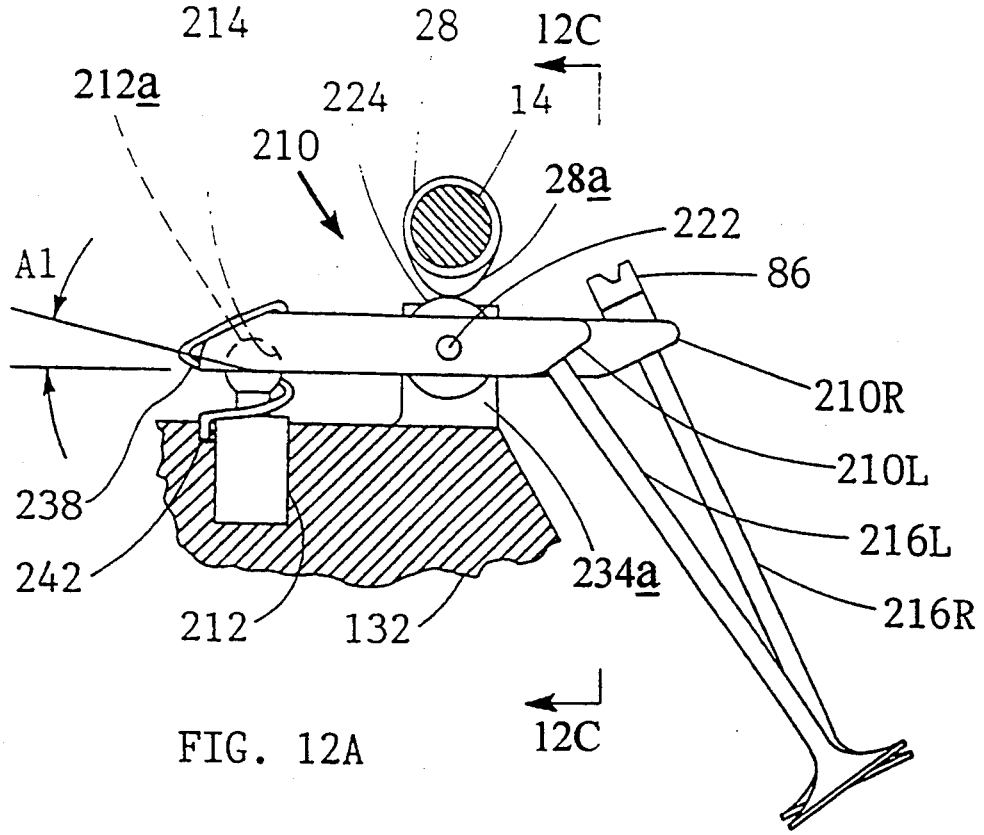
FIG. 12A is a sectional view showing another rocker embodiment for use in my adjustable valve system.
Figure 12B:
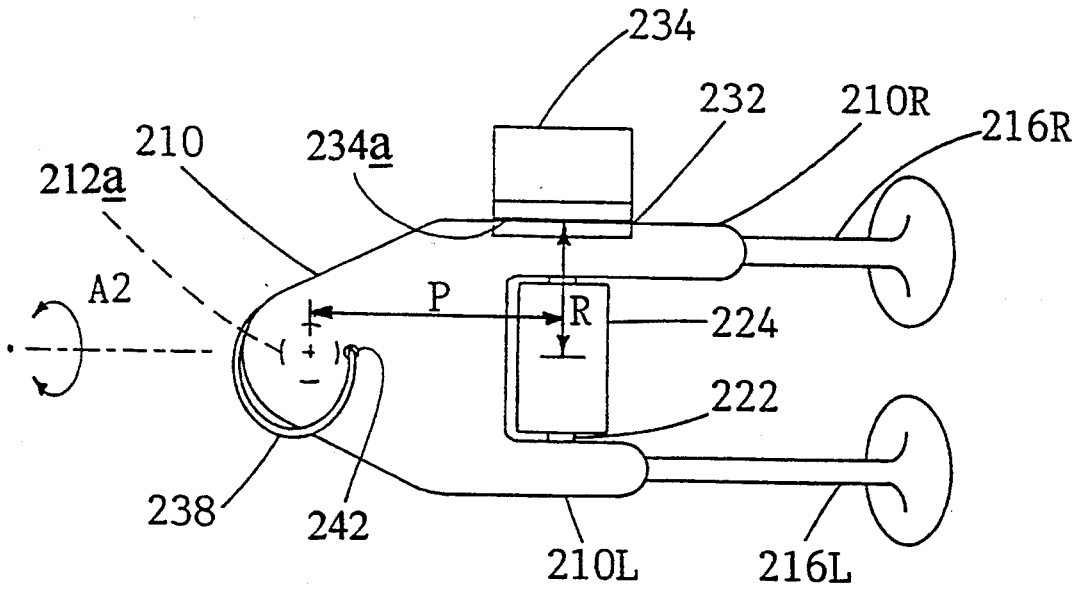
FIG. 12B is a plan view thereof.
Figure 12C:
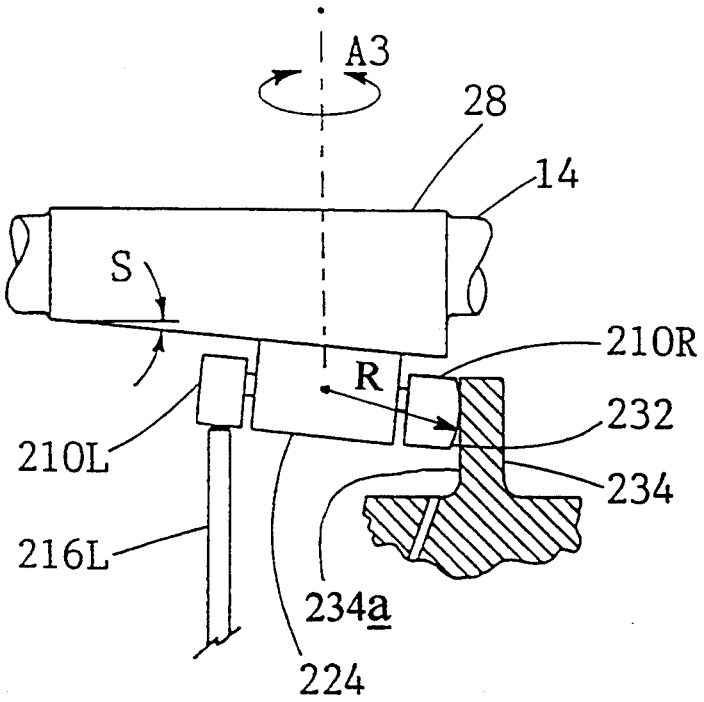
FIG. 12C is a sectional view taken along line 12C—12C of FIG. 12A.

FIGS. 12A to 12C illustrate still another embodiment of my adjustable valve system for use with an overhead camshaft 14 having one or more cams 28. As before, each cam lobe 28*a* has a complex surface profile which changes with axial position along the length of the cam. The illustrated cam lobe 28*a* has an axial slope S that changes with angular rotation of the cam. As before, the cam lobe 28*a* may also be shaped so that its slope S varies along the axial length of the cam.

In this arrangement, each rocker 210 is supported on the cylinder head 132 by an upstanding pedestal 212 having a ball stud 212*a* which engages in a hemispherical recess 214 in the underside of the inboard end of the rocker as described in connection with FIGS. 8 and 10. The rocker has a pair of spaced-apart arms 210L and 210R which extend under camshaft 14 to the stems of the associated valves 216L and 216R that are actuated by that rocker. In this embodiment, the rocker arms are shown as being of unequal length. However, it should be understood that they could have the same length.

A shaft 222 extends between the rocker arms 210L and 210R for rotatably supporting a cam follower 224 which is in engagement with the associated cam 28 of shaft 14. As discussed above in connection with other system embodiments, the rotation of the camshaft 14 causes the rocker 210 to pivot about axes $A_1$ and $A_2$. Also, the timing, lift and valve opening duration profiles of the valves 216L and 216R can be altered by adjusting the camshaft 14 axially with respect to the rocker 210.

In this embodiment, as in the ones described above, an automatic lash adjustor may be associated with pedestal 212 for translating axis $A_1$ from its first location to a second parallel location which brings the follower into contact with the cam. A manual screw-type lash adjustor 86 shown FIG. 12A may be used to adjust the rocker on axis $A_2$ into line contact with the cam when the valves are closed and so that the mating surfaces are parallel. Alternatively, both rocker legs 210L and 210R may be equipped with manual screw-type lash adjustors to perform lash adjustments on axes $A_1$ and $A_2$. To confine the motion of rocker 210 to rotations generally about axes $A_1$ and $A_2$, the side edge of the rocker arm 210R is provided with a wear-resistant bearing surface 232 which is arranged to engage the surface 234*a* of a guide member 234 extending up from a cylinder head 132. Preferably, the bearing surface 232 is rounded so that it has a radius R which is substantially equal to the distance from the axis $A_2$ to the bearing surface, as shown in FIGS. 12B and 12C. This permits the rocker 164 to rotate about the axis $A_2$. It should be noted that at some axial positions of camshaft 14, the bearing surface 232 has rolling or sliding-plus-rolling contact with the surface 234*a* of guide member 234. In order to minimize friction between these surfaces, the radius R as well as the distance P (FIG. 12B) between the follower shaft 222 and the axis of pedestal 212, i.e., axis $A_1$, can be proportioned to cause approximate rolling contact between the surfaces 232 and 234*a*. Of course, suitable lubrication may be provided in order to minimize friction and wear of those surfaces.

As best seen in FIGS. 12A and 12B, a coil spring 238 may be provided to urge the bearing surface 232 of rocker 210 into engagement with the guide member 234. In the illustrated embodiment, spring 238 is a coil spring having one end captured in pedestal 212 and the opposite end captured in a suitable opening 242 in the top of the rocker. The spring is sprung so that it tends to wind up and rotate the rocker 210 counter clockwise as viewed in FIG. 12B thereby biasing the bearing surface 232 against the surface 234*a* of guide member 234. Spring 238 may also hold the rocker down against the ball stud 212*a* of pedestal 212. Of course, other comparable biasing means may be employed. As with the other embodiments described above, the bearing surface 232 prevents the rocker 210 from pivoting substantially about an axis other than axes $A_1$ and $A_2$. In particular, it prevents rotation of the rocker about the vertical axis $A_3$ (FIG. 12C). The lash adjustor 86 enables one to adjust the clearance between rocker arm 210R and valve 216R in order to improve the alignment of rocker 210R relative to rocker arm 210L, with alignment adjustments rotating the rocker a small amount about axis $A_2$. A lash adjustor similar to adjustor 86 may be installed on either or both arms of rocker 210. When installed on both arms, adjustors 86 can adjust the lashes of both axes $A_1$ and $A_2$.

Figure 12D:
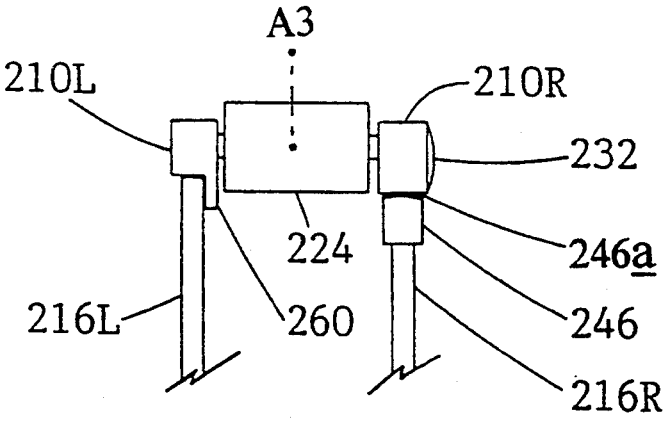
FIG. 12D is a side elevational view of the FIGS. 12A rocker embodiment incorporating a permanent lash adjustor.

FIG. 12D shows a slightly different arrangement employing a semi-permanent lash adjustor on the valve 216R for adjusting lash about axis $A_2$ as described above in the form of a shim or valve stem cap 246 which may have a rounded contact surface 246*a*. When incorporating this type of adjustor, during assembly of the valve train, the clearance between the rocker arm 210R and the valve stem 216R is measured in order to obtain optimum clearance between these two parts. Then, a valve stem cap 246 of appropriate height is selected and installed on the upper end of the valve 216R. It should be noted that misalignment on axis $A_2$ is expected to be due mostly to assembly tolerance and that wear and thermal expansion is expected to have a smaller effect and have yet a smaller net effect on alignment because both valves will wear and thermally expand by approximately equal amounts. Consequently, alignment at the time of valve train assembly may be sufficient for the life of the engine. An automatic lash adjustor may be employed to adjust lash about axis $A_1$. Alternatively, or in addition to an automatic lash adjustor, valve stem caps 246 may be installed on all valves. Of course, the contact portions 246*a* of each cap 246, as well as the upper end of each valve stem are configured to minimize valve stress, wear and vibration. It should be noted also that the contact surface 246*a* of each valve stem cap 246 has bi-directional sliding contact with the associated valve stem end and that the contact surface can be configured so as to avoid transfer of rotational force about axis $A_3$ to the associated valve. Specifically, the contact surface 246*a* shown in FIG. 12D does not include flanges to prevent rotation of the rocker 210 about the vertical axis $A_3$, i.e., act as a substitute for the guide member surface 234*a* (FIG. 12B), because the lateral force on the valve 216L or 216R could cause mechanical failure, accelerated wear and/or oil or fuel leakage past the valve stem guides (not shown). It should be noted, however, that flanges could be arranged on the rocker 210 to prevent rotation of the rocker about axis $A_3$ and away from guide surface 234*a* without causing damage and, in some cases, the flanges could enable the elimination of spring 238. Such a flange 260 is shown in FIG. 12D on the rocker arm 210L. It should be noted that in other arrangements such as the one shown in FIG. 13A, flanges or channels may be used to prevent the rocker from rotating about axis $A_3$. In this embodiment, the cam lobe incline angle may be made sufficiently shallow that the cam does not exert large axial forces and the valve stems and guides may be built stronger to tolerate such forces.

As noted above, the rocker 210 depicted in FIGS. 12 has arms of unequal length. As such, the rocker is similar to the one depicted in FIGS. 8. Therefore, the lift profiles depicted in FIGS. 9A and 9B apply to the valve 216L and 216R which are actuated by rocker 210. As described earlier in connection with FIGS. 8 and 9, those valve opening profiles can be changed by changing the lever arm lengths $L_1$ to $L_5$ illustrated in FIGS. 8A and 8B and the profile of the associated cam lobe 28*a*.

It should be appreciated that all of the rocker arrangements described above permit relatively substantial pivoting of the rocker by the cam 28, which should be distinguished from the minor pivoting which occurs in prior adjustable valve systems in order to accommodate manufacturing and assembly clearances and misalignment of parts due, for example, to wear and thermal expansion.

Figure 13A:
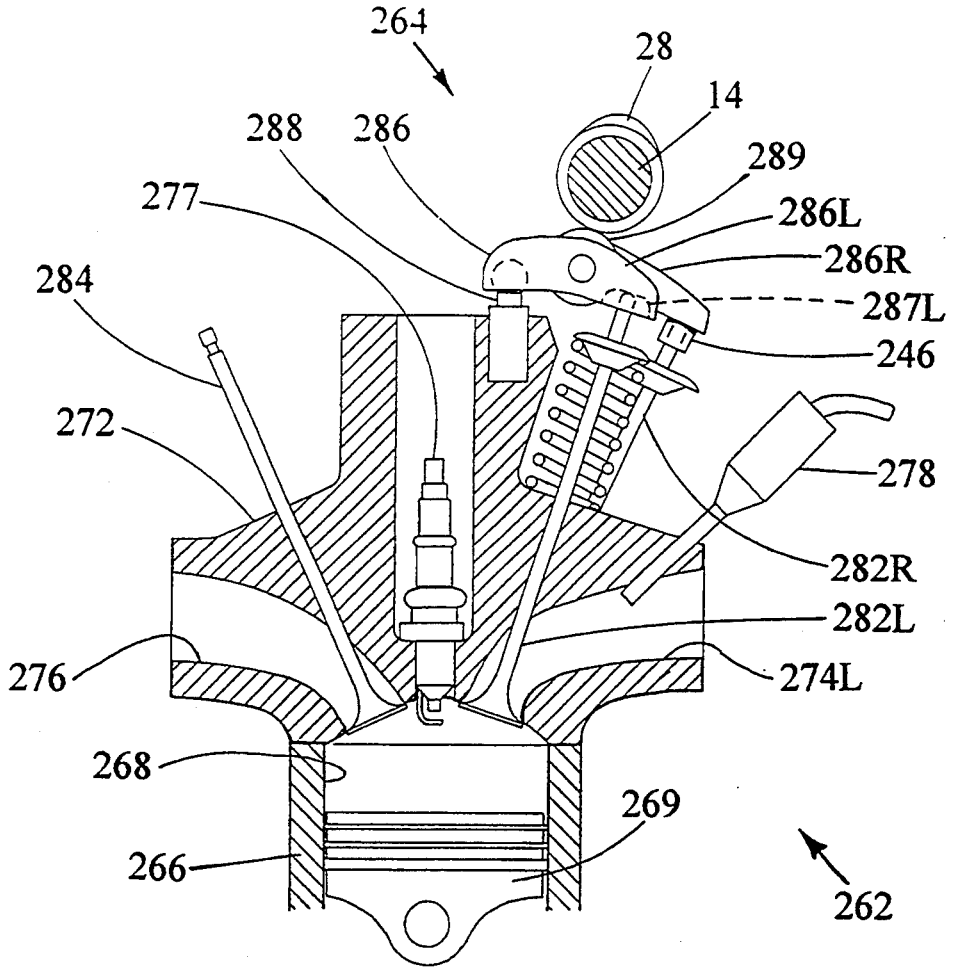
FIG. 13A is a fragmentary sectional view of a gasoline engine incorporating my adjustable valve system.

Refer now to FIG. 13A which shows an engine 262 incorporating my adjustable valve system at 264. System 264 is similar to the one just described in connection with FIGS. 12 which has the advantage of reliable ignition at idle and at low BMEP levels. These advantages are in addition to the primary advantage of reduced pumping loss attained by the adjustable valve system of the present invention.

Engine 262 includes an engine block 266 forming one or more working chambers or cylinders 268 each of which includes a piston 269. Mounted to the top of block 266 is a cylinder head 272 which defines intake ports serving each cylinder, one of which is shown at 274L, and exhaust ports 276. The cylinder head 272 supports a spark plug 277 so that the plug can ignite combustable gases in chamber 268. Also, the cylinder head supports a fuel injector 278 which injects fuel into the intake port 274L. A valve 282L controls the flow of fluid from port 274L into chamber 268. A similar valve 282R is provided at a second intake port serving chamber 268. The flow of exhaust gases from chamber 268 through exhaust port 276 is controlled by an exhaust valve 284.

Valve 282L is opened and closed by a rocker 286 which pivots on a pedestal 288. While the rocker 224 may be a solid member, to save weight, it can also be fabricated out of stamped metal and having a rigidifying skirt or flange at its perimeter. Rocker 286 has a roller-type cam follower 289 which is engaged by a cam 28 of an overhead camshaft 14. If desired, valve stem caps 246 of the type described in connection with FIG. 12D may be provided at the upper end of one or both of the valves. Rocker 286 has left and right arms 286L and 286R, respectively, and arm 286L has a channel 287L. The end of valve 282L fits into channel 287L and prevents rocker 286 from rotating about axis $A_3$.

Figure 13B:
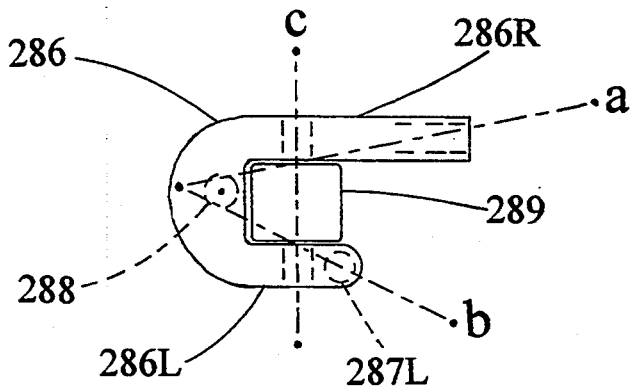
FIG. 13B is a plan view of the valve rocker in the FIG. 13A engine.

Referring to FIGS. 13A and 13B, the rocker 286 in the engine 262 is asymmetric in that one arm 286R of the rocker is longer than the other leg 286L. Preferably, the rocker is designed so that its area of support on pedestal 288 lies within the triangle abc shown in FIG. 13B, a being a line extending from the free end of arm 286R where that leg contacts valve 282R to the nearest point where the follower contacts the cam, e.g., a first end of the line contact adjacent to one side of the follower, b being an extension of the imaginary line extending from the free end of arm 286L where that leg contacts valve 282L to the nearest point where the follower contacts the cam, e.g., the other end of the line contact adjacent to the other side of the follower, and c being the rotary axis of follower 289. Such locating of the pedestal inside the triangle abc prevents the follower 224 from tipping out of line contact with the cam 28.

At engine idle, low BMEP levels or at small engine power levels, intake air enters chamber 268 primarily by way of valve 282L, the other intake valve (not shown) being mostly closed. In some engine embodiments, the cyclic closures of the intake valves, as well as of valve 284, are timed so as to trap some exhaust gas in chamber 268 from the previous combustion cycle. Intake port 274L is configured to angularly rotate or swirl the intake air and, in combination with intake valve 282L opening more than the other intake valve serving chamber 268, generate swirl in chamber 268. Of equal importance, intake port 274L directs the intake fuel-air mixture generally toward the center half of chamber 268 causing the trapped exhaust gas from the previous cycle to be pushed to the perimeter of the chamber as the fresh air enters the chamber, thus creating a stratified charge within chamber 268 of new and old gases. Such a stratified charge improves engine efficiency by concentrating combustion heat at the center of the chamber and reducing heat loss to the chamber walls. Swirl also improves combustion speed and completeness by increasing the mixing of the burning gases.

In some embodiments of the engine 262, the fuel injection from injector 278 into intake port 274L may be timed to produce a fuel-air mixture ratio that is richer than stoichiometric at the center of chamber 268 and in the proximity of spark plug 277 and with generally sustaining the rich mixture near plug 277 and with in generally sustaining stratification of the fuel-air mixture in chamber 268 prior to combustion.

Further, in some engine arrangements, most fuel may be injected by injector 278 into the latter half of the air that enters chamber 268 before the intake valve serving chamber 268 closes in a given cycle. A rich mixture near the spark plug 276 improves ignition reliability and combustion completeness. In this arrangement, stratification of the fuel/air mixture may be established with the fresh intake air and there may or may not be any stratification between old gases and the fresh intake air. In any event, although not illustrated specifically, a catalytic converter may be employed for reducing nitrous oxide and other pollutants. For optimum performance of the converter, the fuel-air mixture ratio in chamber 268 overall should be approximately stoichiometric, necessitating a leaner mixture at the chamber wall because a richer mixture is present at the center of chamber 268.

Figure 14A:
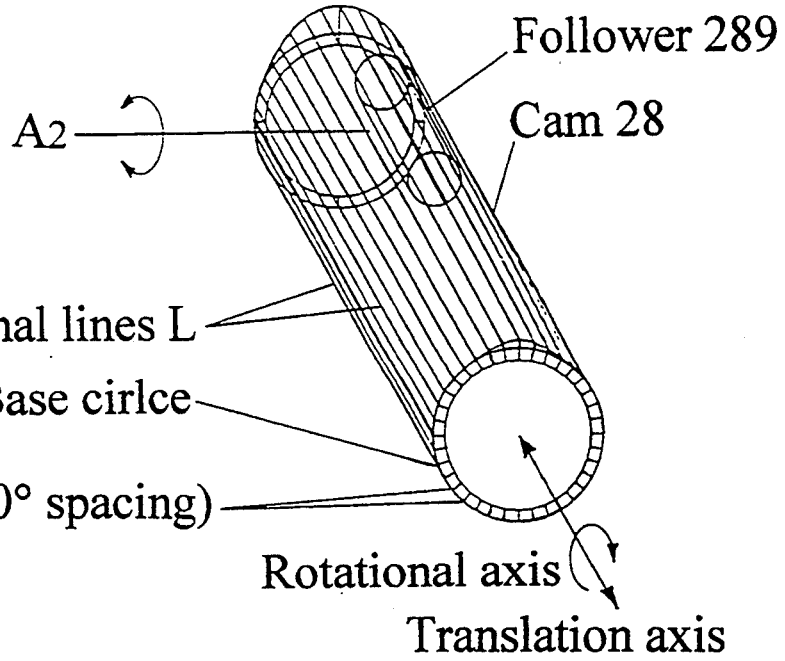
FIG. 14A is a diagrammatic view of a cam and cam follower in the FIG. 13A engine.

Refer now to FIG. 14A which is a detailed view of the cam 28 and roller follower 289 shown in FIG. 13A. Axis $A_2$ is generally perpendicular to the rotational axis of camshaft 14. The roller follower pivots on axis $A_2$ to maintain line contact with the cam lobe. The cam lobe surface is composed of straight longitudinal lines L having constant $\Theta$ values throughout their lengths in order for line contact to be generally maintained between the cam and cam follower as the cam revolves.

Figure 14B:
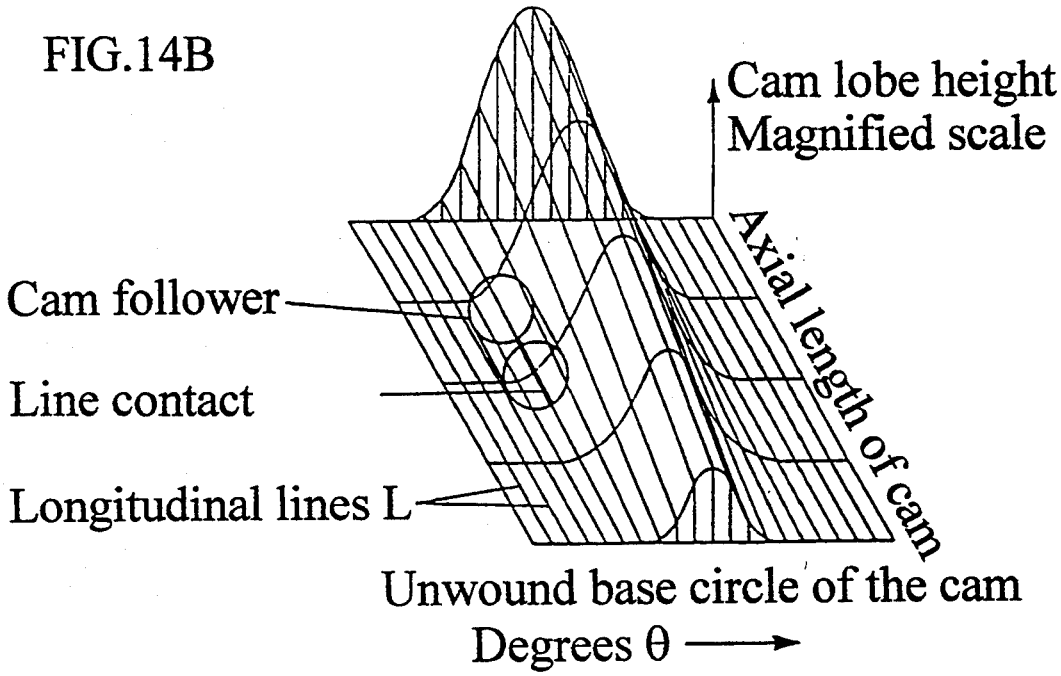
FIG. 14B is a graphical diagram in the form of a topographical map of the surface of a cam in the FIG. 13A engine.

FIG. 14B is a magnified topographical map of the cam lobe surface. The horizontal axis of this graph is the base circle of the cam unwound, the receding axis corresponds to the axial length of the cam, and the vertical axis corresponds to the radial altitude of the cam lobe surface. The cam lobe surface profile is composed of straight longitudinal lines L having a constant Θ value throughout their lengths.

As shown in FIGS. 14A and 14B, in some situations, the lift profiles of the valves can be improved by changing the slope of the longitudinal lines L, and more specifically the lift profiles can be improved by relaxing the requirement for the longitudinal lines to have a constant Θ value and/or to be perfectly straight.

To attain improved lift profiles, deviations from the above-stated general line contact requirement can be made at a partial compromise to system durability. In several instances, the compromise to durability may be small. As one example, if at a given rotational angle of the cam 28, the contact force between the cam and cam follower is at fifty percent of its maximum value, then it would seem reasonable for the load bearing length of the cam line contact and, more specifically, the load bearing footprint surface area to be up to fifty percent shorter, i.e., smaller at this specific rotational position of the two parts. Additionally, it should be noted that, because of the pivoting motion of the rocker about axis $A_1$ not being the same as a straight line translation and because of the radius of curvature of the roller or tappet-type cam follower, line contact may not be exactly established between the cam and the cam follower. In some instances, line contact may actually be improved by slight angulation of the longitudinal lines, curvature of the longitudinal lines and/or curvature of the follower surface in the axial direction. Throughout this specification and in the claims, the term "line contact" should be construed broadly to include these deviations from full-length line contact between the cam and cam follower.

Referring to FIG. 14B, the axial slope of the cam lobe surface plus the centerline height of the cam lobe surface opposite the cam follower determines the lift of the right and left valves. Referring also to FIG. 13A, the axial slope of the cam adds to the lift of valve 282L and the axial slope of the cam subtracts from the lift of valve 282R. At the smallest power levels, in order for the rocker not to separate from valve 282R, the radial height of the cam lobe surface should contribute more to lifting the valve than the slope of the cam contributes to closing the valve.

In some situations, however, it may be desirable for valve 282R not to open at all, and, in particular, at lower engine power levels. In this scenario, the radial height of the cam lobe should contribute less to lifting the valve than the slope of the cam contributes to closing the valve, or vice versa. In this scenario, the valve stem end may separate from the rocker. Consequently, if a channel is being employed to prevent the rocker from rotating about axis $A_5$, the channel should be located on the rocker arm that retains engagement with a valve stem end throughout rotation of the cam, which is valve 282L as shown in FIG. 13A. Additionally, the cam slope and the cam radial height must be established so as to provide low impact realignment of valve 282R with the rocker. One method of accomplishing low impact realignment of the rocker and valve is for the axial height of the cam lobe to contribute the same amount to lifting the valve as the cam axial slope contributes to closing the valve through the full rotation of the cam at a first cam shaft axial position. With this arrangement, if the camshaft is translated from the first position in a first direction, valve 282R will remain closed at all times.

Figure 15A:
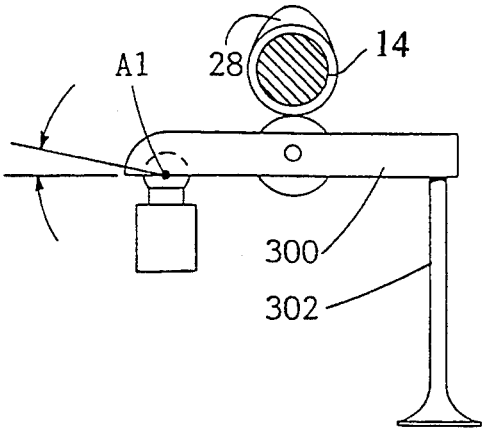
FIG. 15A is a sectional view of another rocker embodiment for use in my valve system.
Figure 15B:
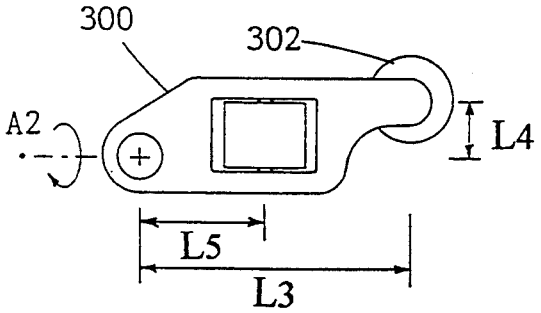
FIG. 15B is a plan view thereof.
Figure 15C:
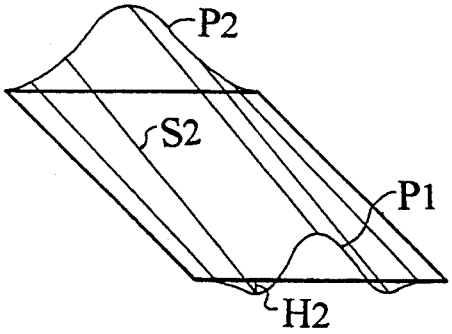
FIG. 15C is a diagrammatical view in the form of a topographical map of the surface of the cam in FIG. 15A.
Figure 15D:
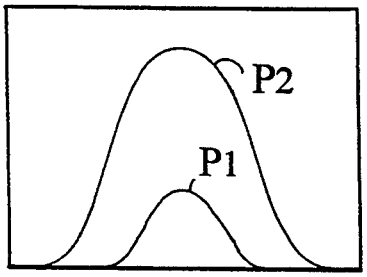
FIG. 15D is a diagrammatical view illustrating the operation of the FIG. 15A system with the cam shown in FIG. 15C.

FIGS. 15A and 15B show a rocker 300 that pivots on axis $A_1$ and $A_2$ in order to displace valve 302. Specifically, when cam shaft 14 rotates cam lobe 28, valve 302 is opened by rocker 300 pivoting on axis $A_2$ and acting through lever arm $L_3$, and by rocker 300 pivoting on axis $A_2$ and acting through lever arm $L_4$. As described above, valve lift and valve open duration can be adjusted by adjusting the axial slope of the cam and by adjusting the radial height of the cam at the point of contact between the cam and cam follower, and by adjusting the length of lever arms $L_3$, $L_4$ and $L_5$. At light power levels, for example, shorter valve open durations are desirable. FIG. 15C shows a cam lobe surface profile having negative radial lift at position $H_2$ in order to subtract from lift induced by slope $S_2$ to provide the desired effect of short valve open duration at light engine power levels. FIG. 15D shows the lift of valve 302 at cam shaft axial positions $P_1$ and $P_2$ for the cam lobe surface shown in FIG. 15C.

It will be seen from the foregoing that my adjustable valve system provides significant advantages over prior comparable systems of this general type. The system can utilize a lower precision and, therefore, a lower cost, camshaft axial positioning mechanism. Yet, it also permits a maximum amount of valve motion adjustability. While having these advantages, the present system still has fewer parts which reduces manufacturing and assembly costs. Indeed, in some embodiments, the system has only approximately one third as many parts as prior comparable adjustable valve systems. Also, the complex camshaft phase shifting mechanisms utilized in some conventional systems of this type are substituted for in the present system by relatively low-cost helical gears for rotating the camshaft.

The present system is less expensive to manufacture for a number of other reasons including the ability to use smaller and, therefore, less expensive camshaft thrust bearings. While being easier and less expensive to manufacture, my system can still use parts which are quite robust and durable because of the increased physical space available between adjacent rockers and because of the other design innovations described above.

Finally, my system significantly improves engine efficiency because it reduces engine pumping losses and because the adjustable valve system has very low internal frictional power losses. This system also contributes to the production of a stratified charge in the engine cylinders which further increases engine efficiency and also provides for reliable ignition at low BMEP power levels.

It will thus be seen that the objects set forth above, among those made apparent from the preceding description, are efficiently attained. Also, certain changes may be made in the above description without departing from the scope of the invention. For example, the illustrated systems could be employed equally well in an engine having only one intake valve per cylinder. Also, each rocker can be arranged to operate three or more valves. In addition, while we have shown the valve system controlling the motions of the engine intake valves, it could just as well be used to control the motions of the exhaust valves. Still further, the system can be arranged to operate with conventional push rods to actuate the valves instead of an overhead camshaft. Finally, while we have described the invention in the context of a spark ignition engine, the system could just as well be incorporated into a diesel or steam engine, or into a expander, compressor or pump. Therefore, it is intended that all matter contained in the above description or shown in the accompanying drawings shall be interpreted as illustrative and not in a limiting sense.

It is also to be understood that the following claims are intended to cover all of the generic and specific features of the invention described herein.

I claim:

1. An adjustable valve system for an engine including an axially shiftable camshaft for connection to a source of rotary power and having at least one valve-actuating cam, said at least one cam having a lobe profile which varies along the axis of the camshaft; positioning means for controlling the axial position of said camshaft in said engine; a plurality of valves movable between open and closed positions for controlling fluid communication with said engine; a rocker, said rocker operatively engaging said plurality of valves; support means disposed in said engine for supporting said rocker; a cam follower mounted to said rocker so as to be in engagement with said at least one cam; pivot means for allowing said follower to pivot relative to said engine about one axis and another axis which are more or less perpendicular to each other so that when said camshaft is rotated, said follower maintains line contact with said at least one cam, and guide means for inhibiting pivoting of said rocker about axes other than said one axis and said other axis at all axial positions of said camshaft.

2. The valve system defined in claim 1 wherein said pivot means includes pivotal connection means between said rocker and said support means which allow said rocker to pivot about said one axis and said other axis; said rocker includes first and second spaced-apart rocker arms, and said plurality of valves includes first and second valves.

3. The valve system defined in claim 1 wherein said rocker has a first contact portion engaging one of said plurality of valves and lash adjustment means for adjusting the clearance between said one of said plurality of valves and said first contact portion so as to adjust the rotational alignment of said follower relative to said cam about said other axis.

4. The valve system defined in claim 3 wherein said lash adjustment means comprises a valve stem cap.

5. An adjustable valve system for an engine including an axially shiftable camshaft for connection to a source of rotary power and having at least one valve-actuating cam, said at least one cam having a lobe profile which varies along the axis of the camshaft; positioning means for controlling the axial position of said camshaft in said engine; a plurality of valves including first and second valves movable between open and closed positions for controlling fluid communication with said engine; a rocker operatively engaging said first and second valves and including first and second spaced-apart rocker arms; support means disposed in said engine for supporting said rocker; a cam follower mounted to said rocker so as to be in engagement with said at least one cam; pivot means for allowing said follower to pivot relative to said engine about one axis and another axis which are substantially perpendicular to each other so that when said camshaft is rotated, said follower maintains line contact with said at least one cam, said pivot means including pivotal connection means between said rocker and said support means which allows said rocker to pivot about said one axis and said other axis, and guide means for inhibiting pivoting of said rocker on axes other than said one axis and said other axis at all axial positions of said camshaft, but permitting substantial pivoting of said rocker about said one axis and said other axis.

6. The valve system defined in claim 5 wherein said guide means include a generally rounded bearing surface on said rocker and a guide, said bearing surface and said guide permitting substantial pivoting of said rocker about said one and said other axes.

7. The valve system defined in claim 6 and further including a flange extending from one of said rocker arms proximate to the valve engaged by that arm, said flange maintaining said bearing surface in engagement with said guide means when said engaged valve is in its closed position, but permitting said bearing surface to move away from said guide means when said engaged valve is in its open position, said flange avoiding transmission of force to said engaged valve when said engaged valve is in its open position.

8. The valve system defined in claim 5 wherein said guide means is on said engine.

9. The valve system defined in claim 5, wherein said support means includes a mounting on said engine, said mounting and said rocker having interfitting surface portions that permit said rocker to pivot about said one and said other axes.

10. An adjustable valve system for an engine including an axially shiftable camshaft for connection to a source of rotary power and having at least one valve-actuating cam, said at least one cam having a lobe profile which varies along the axis of the camshaft; positioning means for controlling the axial position of said camshaft in said engine; a plurality of valves including first and second valves movable between open and closed positions for controlling fluid communication with said engine; a rocker operatively engaging said first and second valves, said rocker including first and second spaced-apart rocker arms which have different lengths and are asymmetrically disposed with respect to said first and second valves so that axial shifting of said camshaft adjusts asymmetrically the opening and closing motions of said first and second valves; support means disposed in said engine for supporting said rocker; a cam follower mounted to said rocker so as to be in engagement with said at least one cam, and pivot means for allowing said follower to pivot relative to said engine about one axis and another axis which are substantially perpendicular to each other so that when said camshaft is rotated, said follower maintains line contact with said at least one cam, said pivot means including pivotal connection means between said rocker and said support means.

11. The valve system defined in claim 10 wherein said first and second rocker arms have first and second contact portions operatively engaging said first and second valves, said first and second contact portions being located at first and second positions relative to said one and other axes so that pivoting motion of said rocker about said one axis displaces said first contact portion by a first amount and pivoting motion of said rocker about said other axis displaces said first contact portion by a second amount, the pivoting about said one axis displacing said second portion by a third amount and the pivoting about said other axis displacing said second portion by a fourth amount whereby said first portion located at said first position is displaced by said first amount from said one axis, said first amount being greater than said third amount resulting from the rotation of said rocker about said one axis.

12. The valve system defined in claim 10 wherein said first and second rocker arms have first and second contact portions operatively engaging said first and second valves, said first and second contact portions being located at first and second positions relative to said one and other axes so that pivoting motion of said rocker about said one axis displaces said first portion by a first amount and pivoting motion of said rocker about said second axis displaces said first portion by a second amount, said pivoting about said first axis displacing said second portion by a third amount and said pivoting about said second axis displacing said second portion by a fourth amount whereby said second portion located at said second position is displaced by said fourth amount from said other axis, said fourth amount being greater than said second amount resulting from the rotation of said rocker about said other axis.

13. An adjustable valve system for an engine which has at least one working chamber and first and second valves controlling fluid communication with said chamber, said system including an axially shiftable camshaft for connection to a source of rotational power and having at least one valve-actuating cam, said at least one cam having a lobe profile which varies along the axis of said camshaft; positioning means for controlling the axial position of said camshaft in said engine; a rocker having contact portions engaging said valves; a cam follower mounted on said rocker in rolling engagement with said at least one cam, and means for pivoting said follower relative to said engine so that the follower can pivot about two axes one of which is oriented at an angle with respect to said camshaft axis and the other of which is generally perpendicular to said one axis, said at least one cam having a length appreciably greater than the distance separating said first and second valves and said follower being pivotable about said axes so that said rocker bears on both of said first and second valves.

14. The adjustable valve system defined in claim 13 in combination with an internal combustion engine.

15. The valve system defined in claim 14 wherein said pivot means are mounted to said engine so as to enable said rocker to pivot relative to said engine about said one and said other axes.

16. The valve system defined in claim 15 and further including guide means limiting pivoting motion of said rocker about axes other than said first and said second axes, but permitting substantial pivoting of said rocker about said first and said second axes.

17. The valve system defined in claim 15 wherein said rocker has first and second spaced-apart rocker arms which engage said first and second valves, respectively, said rocker arms being of different lengths and asymmetrically disposed relative to said first and second valves whereby axial shifting of said camshaft adjusts the displacement motions of said first and second valves asymmetrically.

18. An adjustable valve system for an engine including an axially shiftable camshaft for connection to a source of rotary power and having at least one valve-actuating cam, said at least one cam having a lobe profile which varies along the axis of the camshaft; positioning means for controlling the axial position of said camshaft in said engine; a plurality of valves including first and second valves movable between open and closed positions for controlling fluid communication with said engine; a rocker having first and second spaced-apart rocker arms of different lengths which operatively engage said first and second valves, respectively; support means disposed in said engine for supporting said rocker; a cam follower mounted to said rocker so as to be in engagement with said at least one cam, and pivot means for allowing said rocker to pivot relative to said engine about two axes which are more or less perpendicular to each other so that when said camshaft is rotated, said follower maintains substantial line contact with said at least one cam.

19. The valve system defined in claim 18 wherein said rocker arms are disposed asymmetrically relative to said first and second valves whereby axial shifting of said camshaft adjusts the displacement motions of said first and second valves asymmetrically.

20. The valve system defined in claim 18 wherein said rocker arms are disposed asymmetrically relative to said first and second valves whereby axial shifting of said camshaft adjusts the lift of said first valve a first amount and adjusts the lift of said second valve a second amount smaller than said first amount.

21. The valve system defined in claim 18 wherein said rocker arms are disposed asymmetrically relative to said first and second valves whereby axially shifting said camshaft from a first position to a second position increases the lift of said first and second valves, and decreases the difference in lift between said first and second valves.

22. An adjustable valve system for an engine including an axially shiftable camshaft for connection to a source of rotary power and having at least one valve-actuating cam, said at least one cam having a lobe profile which varies along the axis of the camshaft; positioning means for controlling the axial position of said camshaft in said engine; a plurality of valves including first and second valves movable between open and closed positions for controlling fluid communication with said engine; a rocker having first and second spaced-apart rocker arms which engage said first and second valves, respectively, said rocker defining a first lever arm which extends perpendicularly from a first axis to said first valve and a first rocker engagement point, a second lever arm which extends perpendicularly from a second axis to said first valve and said first rocker engagement point a third lever arm which extends perpendicularly from said first axis to said second valve and a second rocker engagement point and a fourth lever arm which extends perpendicularly from said second axis to said second valve and said second rocker engagement point, said first and second ones being substantially perpendicular to one another for allowing said first valve to be displaced by said first and second pivoting lever arms and for allowing said second valve to be displaced by said third and fourth pivoting lever arms so that axial shifting of said camshaft adjusts the displacement motion of said first and second valves asymmetrically.

23. The valve system defined in claim 22 and further including guide means limiting pivoting motion of said rocker about axes other than said first axis and said second axis, but permitting substantial pivoting of said rocker about said first and second axis.

24. The valve system defined in claim 23 wherein said guide means includes a generally rounded bearing surface on said rocker and a guide mounted on said engine, said rocker having a rotational torque about a third axis in a first direction in reaction to force applied by said cam lobe profile, said bearing surface and said guide permitting substantial pivoting of said rocker about said first axis and said second axis but not about said third axis in said first direction.

25. The valve system defined in claim 24 and further including a flange extending from one of said rocker arms proximate to the valve engaged by that arm, said flange maintaining said bearing surface in engagement with said guide means and preventing said rocker from rotating about said third axis in a second direction away from said guide.

26. An adjustable valve system for an internal combustion engine which has at least one working chamber and first and second valves controlling fluid communication with said chamber, said system including an axially shiftable camshaft for connection to a source of rotary power and having at least one valve-actuating cam, said at least one cam having a lobe profile which varies along the axis of said camshaft; positioning means for controlling the axial position of said camshaft in said engine; a rocker having a follower for engagement with said at least one cam and contact portions for engaging said valves; means for pivoting said follower relative to said engine so that said follower can pivot about first and second axes, said first axis being oriented at an angle with respect to said camshaft axis and said second axis being generally perpendicular to said first axis, said at least one cam having a length appreciably greater than the distance separating said contact portions and said follower being pivotable about said first axis and said second axis so that when said camshaft rotates, said rocker bears on both of said valves and said follower maintains substantial line contact with said cam.

27. The valve system defined in claim 26 wherein said rocker has first and second spaced-apart rocker arms which engage said first and second valves, respectively, said rocker arms having different lengths and being asymmetrically disposed relative to said first and second valves whereby axial shifting of said camshaft adjusts the displacement motions of said first and second valve asymmetrically.

28. The valve system defined in claim 27 and further including guide means limiting pivoting motion of said rocker about axes other than said first axis and said second axis, but permitting substantial pivoting of said rocker about said first axis and said second axis.

29. The valve system defined in claim 28 wherein said guide means includes a generally rounded bearing surface on said rocker and a guide mounted on said engine, said rocker having a rotational torque about a third axis in a first direction in reaction to force applied to said cam lobe profile, said bearing surface and said guide permitting substantial pivoting of said rocker about said first axis and said second axis but not about said third axis in said first direction.

30. The valve system defined in claim 29 and further including a flange extending from one of said rocker arms proximate to the valve engaged by that arm, said flange maintaining said beating surface in engagement with said guide means and preventing said rocker from rotating about said third axis in a second direction away from said guide.

31. An adjustable valve system for an engine including an axially shiftable camshaft for connection to a source of rotary power and having a valve-actuating cam, said cam having a lobe profile which varies along the axis of the camshaft; positioning means for controlling the axial position of the camshaft; a plurality of valves movable between open and closed positions; a rocker operatively engaging said plurality of valves; support means for movably supporting said rocker; a cam follower mounted to said rocker so as to be in engagement with said cam, and guide means for confining the motion of said rocker to pivoting motion about two mutually perpendicular axes so that when said cam shaft is rotated, said follower maintains substantial line contact with said cam at all axial positions of said camshaft.

32. The valve system defined in claim 31 wherein said follower is a roller-type follower.

33. The valve system defined in claim 31 wherein said rocker includes a pair of spaced-apart rocker arms which have different lengths.

34. The valve system defined in claim 31 and further including lash adjustment means associated with at least one of said plurality of valves for adjusting the clearance between said at least one valve and said rocker.

35. An adjustable valve system for an engine including an axially shiftable camshaft for connection to a source of rotary power and having a valve-actuating cam, said cam having a lobe profile which varies along the axis of the camshaft; positioning means for controlling the axial position of the camshaft; a plurality of valves movable between open and closed positions; a rocker having first and second spaced-apart rocker arms operatively engaging said plurality of valves, said arms having different lengths and being asymmetrically disposed with respect to said plurality of valves so that axial shifting of said camshaft adjusts asymmetrically the opening and closing motions of said plurality of valves; a cam follower mounted to said rocker so as to be in engagement with said cam, and pivot means for allowing said rocker to pivot relative to said engine about mutually perpendicular axes so that when said camshaft is rotated, said follower maintains substantive line contact with said cam.

36. The valve system defined in claim 35 wherein said follower is a roller-type follower.

37. The valve system defined in claim 35 and further including lash adjustment means associated with at least one of said plurality of valves for adjusting the clearance between said at least one valve and said rocker.

* * * * *